US012018219B2

(12) United States Patent
Kyle et al.

(10) Patent No.: US 12,018,219 B2
(45) Date of Patent: Jun. 25, 2024

(54) CRUDE OIL TRANSPORTATION

(71) Applicant: INFINEUM International Limited, Abingdon (GB)

(72) Inventors: Nichola Kyle, Oxfordshire (GB); Paul D. Kerby, Victoria (AU); Colin Morton, Standford-in-the-Vale (GB); Michael S. Perryman, Oxfordshire (GB)

(73) Assignee: INFINEUM INTERNATIONAL LTD. (GB)

( * ) Notice: Subject to any disclaimer, the term of this patent is extended or adjusted under 35 U.S.C. 154(b) by 0 days.

(21) Appl. No.: 17/648,965

(22) Filed: Jan. 26, 2022

(65) Prior Publication Data

US 2022/0235285 A1 Jul. 28, 2022

(30) Foreign Application Priority Data

Jan. 26, 2021 (EP) ..... 21153482

(51) Int. Cl.
*C10G 75/04* (2006.01)

(52) U.S. Cl.
CPC ..... *C10G 75/04* (2013.01); *C10G 2300/206* (2013.01); *C10G 2300/4075* (2013.01)

(58) Field of Classification Search
CPC ..... C10G 75/04; C10G 2300/206
See application file for complete search history.

(56) References Cited

U.S. PATENT DOCUMENTS

2010/0050503 A1* 3/2010 Kuroda ..... C10L 1/14 44/361
2010/0175315 A1* 7/2010 McRobbie ..... C10L 10/00 44/603

FOREIGN PATENT DOCUMENTS

| | | | |
|---|---|---|---|
| EP | 1191085 | A1 | 3/2002 |
| EP | 2107103 | A1 | 7/2009 |
| WO | 2006047745 | A1 | 4/2006 |
| WO | 2009013536 | A2 | 1/2009 |
| WO | 2019006004 | A1 | 1/2019 |

OTHER PUBLICATIONS

European Search Report Application No. 21153482.1.

* cited by examiner

*Primary Examiner* — Randy Boyer

(57) ABSTRACT

A method of improving the transportation of a crude oil which has been recovered from a crude oil well, the method comprising adding one or more glycerophospholipid(s) to a crude oil before and/or during the transportation of said crude oil.

19 Claims, No Drawings

CRUDE OIL TRANSPORTATION

FIELD OF THE INVENTION

This invention relates to an improved method of transporting a crude oil which has been recovered from a crude oil well. Suitably, the crude oil may be transported by a flow line (e.g., tubing, piping or pipeline), road vehicle, rail vehicle or watercraft, especially by a flow line. In particular, although not exclusively, the invention relates to an improved method of transporting a crude oil which has been recovered from a crude oil well to a petroleum refinery in one or more transportation stages.

Further, the invention relates to a method for increasing the capacity of a crude oil to solvate and/or disperse asphaltenes in the crude oil, especially such a crude oil which has an asphaltene content, by adding one or more glycerophospholipid(s) to the crude oil. The invention also relates to a method for enhancing the solubility and/or dispersibility of asphaltenes in a crude oil, especially such a crude oil which has an asphaltene content, by adding one or more glycerophospholipid(s) to the crude oil. The invention also relates to a method for reducing the deposition of asphaltenes solvated and/or dispersed in a crude oil by adding one or more glycerophospholipid(s) to the crude oil. Further, the invention relates to the use of one or more glycerophospholipid(s) as an additive in crude oil to enhance the solubility and/or dispersibility of asphaltenes in the crude oil. Further, the invention relates to the use of one or more glycerophospholipid(s) as an additive in crude oil to increase the capacity of crude oil to solvate and/or disperse asphaltenes in the crude oil. Still further, the invention relates to the use of one or more glycerophospholipid(s) as an additive in crude oil to reduce the deposition of asphaltenes from a crude oil.

Suitably, the invention relates to improving the flow characteristics of a crude oil which has been recovered from a crude oil well. Further, the invention relates to reducing or preventing fouling, especially asphaltene fouling, by a crude oil which has been recovered from a crude oil well. Accordingly, the invention facilitates the transportation of crude oil and/or reduces fouling by crude oil when stored in storage tanks, passing through processing equipment, and being transported by transportation means (e.g., flow lines, such as piping and pipelines). Typically, this reduces the need, and associated down time(s), for cleaning and maintenance of processing equipment, storage tanks and associated transportation means (e.g., flow lines, such as pipelines).

Suitably, the invention may be used in one or more crude oil transportation and/or processing operations performed on a crude oil which has been recovered from an underground source and before the crude oil is subsequently refined in a petroleum refinery operation, for example: (i) before and/or during processing of the crude oil to separate gas and water from the crude oil; (ii) during storage of the crude oil in storage tanks; (iii) before and/or during transportation of the crude oil by pipeline, marine vessel, road vehicle and/or rail vehicle from a crude oil well to a petroleum refinery, and at any intermediate stages thereof en-route to said petroleum refinery; (iv) before and/or during a blending operation including the crude oil (e.g., blending the crude oil with a different type/grade of crude oil); and, (v) upgrading a heavy crude oil to a lighter crude oil.

The invention also provides improvements in anti-fouling performance during petroleum refinery operations of a petroleum feedstock (e.g., a crude oil recovered from a crude oil well), which is heated at elevated temperatures during the refinery operation.

BACKGROUND OF THE INVENTION

A crude oil typically includes asphaltenes. Asphaltenes include molecules having a large number of different and complex structures. Typically, asphaltenes comprise of polyaromatic molecules, such as unsaturated macromolecules primarily of carbon and hydrogen but also containing minor components such as sulfur, oxygen, nitrogen and/or various metals, particularly heavy metals. Asphaltenes are characterized in terms of their solubility in aromatic solvents, and they are more commonly defined as that portion of a crude oil, which is soluble in xylene and toluene, but insoluble in paraffinic solvents, such as heptane or pentane.

Asphaltenes typically exist in crude oil as soluble species and/or in the form of a colloidal dispersion, through interactions with resins present in the crude oil (e.g., asphaltenes are solvated by interactions with the resins in a crude oil). Suitably, the solubility and/or dispersibility of asphaltenes in a crude oil, and the ability of a crude oil to solvate or disperse asphaltenes therein, is delicately balanced and this balance may be disturbed and/or disrupted, for example, by pressure changes and/or temperature changes and/or compositional changes (e.g., during recovery of crude oil from an underground source, separating gas and water from a crude oil recovered from a crude oil well, during a refinery operation performed on the crude oil, upgrading a heavy crude oil to a lighter crude oil, blending two or more different crude oils together, or blending a crude oil with a hydrocarbon fluid), or by other mechanical or physical processing operations performed on crude oil.

Typically, crude oil is recovered from an underground source (i.e., an underground crude oil reservoir) by drilling a bore hole to the underground source with a drilling rig to form a crude oil recovery well. Suitably, the recovery well comprises a wellbore which comprises a flow path to permit crude oil to flow from the underground source to the surface (i.e., the flow path permits crude oil to flow from the underground reservoir to the opening of the recovery well above ground). The recovery of crude oil from the reservoir may be achieved by a primary recovery process (e.g., using natural processes), a secondary recovery process (e.g., water flooding of the crude oil reservoir) to increase oil-production rate and overall output from the well, an enhanced recovery process (e.g., thermal recovery, such as, steam flooding of the crude oil reservoir), which is typically used to extract the heavy crude oil, or a combination of such processes.

Accordingly, as crude oil is recovered from the underground source and brought to the surface, the crude oil typically cools and is subjected to reduced pressure, and the composition of the crude oil may change. These physical and/or chemical modifications typically reduce the capacity of a crude oil being recovered from an underground reservoir to solvate and/or disperse asphaltenes therein, and/or reduces the solubility and/or dispersibility of asphaltenes in the crude oil. The diminished capacity of crude oil to solvate asphaltenes, and the reduced solubility/dispersibility of asphaltenes in crude oil, typically becomes more pronounced as the crude oil flows in a direction from the underground reservoir towards the well opening above ground.

Suitably, crude oil recovered from a crude oil well typically has a reduced capacity for solvating and dispersing asphaltenes therein. Further, the solubility and dispersibility of asphaltenes in the crude oil recovered from the well may be reduced. Accordingly, deposition of asphaltenes from the crude oil may increase. This presents various problems for handling, storing, processing and/or transporting the crude oil which has been recovered from the well. For example, it may promote the formation of asphaltene deposits that may plug and/or restrict oil flow in choke off pipes, safety shut off valves, separator equipment (e.g., to remove gas and water from the crude oil), flow lines (e.g., production lines, pipelines), storage vessels, blending equipment and associated process transport mechanisms. These less desirable flow characteristics typically reduce the overall rate of production and overall output of the crude oil well, as equipment is ordinarily taken offline and cleaned mechanically or chemically cleaned, resulting in lost production time and increased operating costs.

Further, crude oil recovered from different geographical locations typically has its own unique physical properties (e.g., viscosity and volatility) and chemical composition (e.g., asphaltene content, sulfur content). Crude oil ranges in density and consistency, from relatively thin, light weight fluid oils to extremely thick, semi-solid heavy weight oils. Lower quality heavy crude oils typically include a higher quantity of asphaltenes, and/or sulfur and other impurities, compared with higher quality lighter crude oils. The heavy grade crude oils are typically too viscous to flow through associated process flow lines (e.g., pipes or pipelines). Moreover, certain petroleum refineries may only be capable of refining the lighter crude oils and not the heavy lower grade crude oils.

Accordingly, the heavy lower grade crude oils may be diluted/blended with a different lighter grade of crude (or another hydrocarbon fluid) to provide a crude oil blend having the desirable viscosity, volatility and chemical compositional characteristics to facilitate ease of handling, storage, transportation (e.g., by pipeline, tanker or ship) between the wellbore reservoir region and a petroleum refinery which has the capability of refining heavy crude oil feedstocks. For example, it may be desirable to blend a lower quality heavy crude oil having a high viscosity and high asphaltene content with a higher quality light crude oil having a lower viscosity and lower asphaltene content and/or with a hydrocarbon oil. However, it is recognised that mixing two different types of crude oil together may form a crude oil blend having a significantly lower capacity for solvating and/or dispersing asphaltenes. This diminished capacity for solvating and/or dispersing asphaltenes has been found to occur in such blends of crude oil, even when no asphaltene insolvency exists in either of the different types of crude oil alone constituting the blend.

Alternatively, the heavy lower grade crude oil can be upgraded to a lighter synthetic crude oil which is significantly less viscous and contains significantly less impurities. The lighter synthetic crude oil can be transported (e.g., through flow lines, such as pipes) more easily than the heavier crude oil and may also be refined at a petroleum refinery, which only has the capability of processing lighter crude feedstocks.

Suitably, such crude oil processing operations may further reduce the capacity of a crude oil to solvate and/or disperse asphaltenes therein, and/or reduce the solubility, and/or dispersibility of asphaltenes in the crude oil.

Petroleum refineries incur significant additional energy costs due to fouling and the resulting attendant inefficiencies caused by the fouling. More particularly, thermal processing of crude oils, blends of crude oils and fractions obtained therefrom in refinery vessels, for example heat transfer equipment such as heat exchangers and fired heaters, is hampered by the deposition of insoluble asphaltenes and other contaminants (e.g., particulates and salts) that may be found in crude oils, blends of crude oils, and fractions obtained therefrom which are refined further in a petroleum refinery. Further, the asphaltenes and other organics may thermally degrade to coke when exposed to high surface temperatures, for example high heater tube surface temperatures, found in a petroleum refinery operation.

Fouling in refinery vessels, such as heat transfer equipment, receiving petroleum feedstocks due to thermal instability of the feedstock and deposit of materials rendered insoluble by the temperature difference ($\Delta T$) between the feedstock and the refinery vessel wall (e.g., heat exchanger wall) represents a major problem in petroleum refinery operations, especially as the feedstock is typically heated to elevated temperatures, for example in some refinery operations at temperatures in excess of 300° C.

Heating a refinable petroleum feedstock at such elevated temperatures, especially during a petroleum refinery operation, can promote asphaltene agglomeration in and asphaltene precipitation in and/or from the feedstock, thermal degradation of asphaltenes to coke and adherence of asphaltenes and/or coke to the hot surfaces of the refinery vessel. Further, the high $\Delta T$ found in heat transfer refinery operations results in high surface or skin temperatures when the petroleum feedstock is introduced to the refinery vessel. This high $\Delta T$ may further contribute to the precipitation of asphaltenes and other insoluble particulates from the feedstock. During the refinery operation of a petroleum feedstock the asphaltene macromolecules are stripped to form molecules having significantly different chemical structures in the finished refined product. Although such molecules in the finished refined product may also be termed as asphaltenes, these molecules have significantly different chemical and physical properties than the precursor asphaltene molecules present in the refinable petroleum feedstock (e.g., as found in crude oil).

The build-up of insoluble deposits in a refinery vessel, such as heat transfer equipment, creates an unwanted insulating effect and reduces the heat transfer efficiency of the vessel. Fouling also reduces the cross-sectional area of process equipment, which decreases flow rates and desired pressure differentials to provide less than optimal operation. To overcome these disadvantages, the refinery vessel is ordinarily taken offline and cleaned mechanically or chemically cleaned, resulting in lost production time and in certain circumstances complete outage of part, or all, of a petroleum refinery operation.

Suitably, a reduction in the capacity of a crude oil to solvate and/or disperse asphaltenes therein, and/or a reduction in the solubility and/or dispersibility of asphaltenes in a crude oil, and/or the increased deposition of asphaltenes from a crude oil, presents problems for those operating in the crude oil industry.

Accordingly, there is a need to maintain, and preferably enhance, the capacity of a crude oil or blend of crude oils, to solvate and/or disperse asphaltenes therein, especially a crude oil which has been recovered from a crude oil well.

Accordingly, there is a need to maintain, and preferably enhance, the solubility and/or dispersibility of asphaltenes in a crude oil or blend of crude oils, especially a crude oil which has been recovered from a crude oil well.

Accordingly, there is a need to reduce the deposition of asphaltenes from a crude oil or blend of crude oils, especially a crude oil which has been recovered from a crude oil well.

Accordingly, there is a need to improve the flow characteristics of a crude oil, such as crude oil stream, which has been recovered from a crude oil well to facilitate the ease of handling and/or transportation of the crude oil by associated transport mechanisms. Suitably, the crude oil stream may be flowing from the crude oil well, it may be processed at the wellbore region, or it may be transported from the wellbore region to a petroleum refinery by one or more transportation stages.

Accordingly, there is a need to reduce fouling of a refinery vessel which is used to refine a refinable petroleum feedstock (e.g., a crude oil) in a petroleum refinery operation, wherein the refinable petroleum feedstock is at an elevated temperature during the refinery operation.

Further, there is a need to reduce deposition and/or precipitation of particulates, especially precipitation of asphaltenes, in and/or from a refinable petroleum feedstock (e.g., a crude oil) and to reduce agglomeration of asphaltenes in a refinable petroleum feedstock when the feedstock is heated at an elevated temperature during a petroleum refinery operation.

Further, there is a need to reduce adherence of particulates, especially adherence of asphaltenes, to the heated surface of a refinery vessel during a refinery operation of a refinable petroleum feedstock, thereby preventing and/or mitigating fouling of the vessel, and before the asphaltenes are thermally degraded or coked. This will improve the overall efficiency of the refinery operation, increase performance of heat transfer equipment, reduce or eliminate scheduled outages for fouling mitigation efforts, and reduce energy costs associated with the refinery operation.

Suitably, one or more of the above desirable improvements may enhance the overall efficiency, enhance production rates, enhance output, reduce or eliminate scheduled outages for fouling mitigation efforts, and reduce operating and energy costs associated with handling, storing, transporting, processing (e.g., blending two or more crude oils), and/or refining a crude oil which has been recovered from a crude oil well.

SUMMARY OF INVENTION

The invention seeks to solve some of the technical problems associated with handling, storing, transporting and/or processing a crude oil recovered from a crude oil well due to the presence of asphaltenes in said crude oil.

Suitably, the invention seeks to provide improvements for enhancing the capacity of a crude oil to solvate and/or disperse asphaltenes in said crude oil. Further, the invention seeks to provide improvements for increasing the solubility and/or dispersibility of asphaltenes in a crude oil. Further, the invention seeks to provide improvements for reducing the deposition of asphaltenes from a crude oil.

In particular, the invention provides an improved method for transporting a crude oil which has been recovered from a crude oil well. Suitably, the crude oil may be transported by a crude oil flow line, such as a pipe, tube or pipeline, by road vehicle, by railway vehicle, or by watercraft, preferably by a crude oil flow line. Suitably, the flow characteristics of the crude oil are improved as the crude oil is treated to enhance the capacity of said crude oil to solvate and/or disperse asphaltenes therein, and/or to increase the solubility and/or dispersibility of asphaltenes in said crude oil, and/or to reduce deposition (e.g., precipitation) of asphaltenes from said crude oil.

Further, the invention provides a process for enhancing the capacity of crude oil, or a blend of two or more different types of crude oil, which has been recovered from an underground crude oil source to solvate and disperse asphaltenes therein and before said crude oil, or crude oil blend, is processed in a petroleum refinery operation.

Further, the invention provides a process for enhancing the dispersibility and/or solubility of asphaltenes in crude oil, or a blend of two or more different types of crude oil, which has been recovered from an underground crude oil source before said crude oil, or crude oil blend, is processed in a petroleum refinery operation.

Further, the invention provides a process for reducing the deposition (e.g., precipitation) of asphaltenes from crude oil, or a blend of two or more different types of crude oil, which has been recovered from an underground crude oil source before said crude oil, or crude oil blend, is processed in a petroleum refinery operation.

Still further, the invention provides improvements in anti-fouling performance during petroleum refinery operations of a petroleum feedstock having an asphaltene content (e.g., a crude oil or blend of crude oils), which is heated at elevated temperatures during the refinery operation.

Thus, in a first aspect, the invention provides a method of improving the transportation of a crude oil which has been recovered from a crude oil well, the method comprising the steps of: (i) adding one or more glycerophospholipid(s), as defined herein, to a crude oil before and/or during the transportation of said crude oil; and, (ii) transporting the crude oil by a crude oil flow line (e.g., pipe, tubular structure, pipeline), by road vehicle, by railway vehicle or by watercraft, or a combination thereof.

Preferably, the crude oil is transported by a crude oil flow line, such as a pipe, tubular structure or pipeline.

Preferably, the crude oil comprises a crude oil stream. Preferably, the crude oil stream is transported by a crude oil flow line, for example, a pipe, tubular structure or pipeline. Preferably, the one or more glycerophospholipid(s) is added to the crude oil stream.

Suitably, the crude oil stream may be flowing from and exiting the crude oil recovery well. Suitably, the crude oil stream may be flowing from the underground crude oil reservoir to the crude oil recovery well opening located above ground via the well bore flow path (e.g., through a production riser). Suitably, the crude oil stream may be transported to and/or from a crude oil processing operation (e.g., an operation to remove gas and water from the crude oil or a blending operation including the crude oil). Suitably, the crude oil stream may be transported to a petroleum refinery in one or more transportation stages. Preferably, said crude oil stream(s) is transported by a crude oil flow line, for example, piping, tubular structure or pipeline.

Suitably, the one or more glycerophospholipid(s) is added to the crude oil, especially a crude oil stream, after the crude oil has been recovered from the crude oil well. However, it will be appreciated that the one or more glycerophospholipid(s) may be added to the crude oil, especially a crude oil stream, that is present in the wellbore flow path (e.g., the production riser).

Alternatively, or additionally, the one or more glycerophospholipid(s) is added to the crude oil before transportation of the crude oil. Suitably, the one or more glycerophospholipid(s) is added to the crude oil during storage of the crude oil (e.g., during storage of the crude oil in a storage tank) and/or during a crude oil processing operation performed on the crude oil (e.g., a processing operation to remove gas and water from the recovered crude oil or a blending operation including the crude oil).

It will be appreciated that during the transportation of the crude oil, the crude oil may be transported in a vertical direction, a horizontal direction, and/or a combination of horizontal and vertical directions.

Suitably, the crude oil comprises any grade(s) of pre-refined crude oil which has not been refined at a petroleum refinery. Suitably, the crude oil may comprise a single grade of crude oil, a blend of two or more different grades of crude oil, and an upgraded crude oil (i.e., a lighter grade crude oil formed from a heavy grade crude oil which is subsequently refined at a petroleum refinery).

Suitably, said one or more glycerophospholipid(s) may be in solid form (e.g., particulates, powder) or liquid form, such as for example, a solution, dispersion, suspension or emulsion.

Preferably, the one or more glycerophospholipid(s) is in liquid form. More preferably, said one or more glycerophospholipid(s) is in liquid form and includes an organic solvent, especially an aromatic solvent. Preferred aromatic solvents include xylene, benzene and/or toluene. Suitably, when the one or more glycerophospholipid(s) is in liquid form, the formulation may also include a surfactant.

Suitably, the one or more glycerophospholipid(s) is added to said crude oil by delivery means.

Suitably, the type of delivery means will be dictated, to a certain extent, by the form of said glycerophospholipid(s) being added to the crude oil and/or if the glycerophospholipid(s) is added during or before the transportation of the crude oil. Suitable delivery means for delivering additives to crude oil are well known to those skilled in the art. Preferred delivery means comprise dosing systems, such as injector means, to allow controllable addition of said glycerophospholipid(s) to the crude oil. Alternative, and or additional, delivery means include delivery flow lines (e.g., pipes, tubes and/or tubular structures). It will be appreciated that the delivery means may include a combination of a dosing system and delivery flow line(s).

Preferably, the delivery means includes a dosing system, preferably an injector means, to allow controllable addition of the glycerophospholipid(s) to the crude oil. Suitably, the dosing system is in fluid communication with a source of glycerophospholipid(s) (e.g., the dosing system and source of glycerophospholipid(s) may represent an integrated system or the dosing system may be connected to a separate source of glycerophospholipid(s) by one or more delivery flow lines). Preferably, the delivery means includes a dosing system, especially injector means, to allow controllable addition of said glycerophospholipid(s) to the crude oil and said dosing system is in fluid communication with a separate source of glycerophospholipid(s) by associated delivery flow line(s).

Alternatively, the delivery means may include one or more delivery flow line(s) only, wherein the delivery flow line(s) allow fluid communication between the crude oil and said one or more glycerophospholipid(s). Suitable delivery flow lines comprise tubing, piping or tubular structure(s).

Preferably, the one or more glycerophospholipid(s) is in liquid form and said delivery means comprises a dosing system to allow controllable addition of said one or more glycerophospholipid(s) to said crude oil. Even more preferably, said one or more glycerophospholipid(s) is in liquid form and the dosing system includes injector means to allow controllable addition of said one or more glycerophospholipid(s) to the crude oil.

In preferred embodiment of the invention, where the one or more glycerophospholipid(s) is added to a crude oil stream being transported in a crude oil flow line, said one or more glycerophospholipid(s) is in liquid form, and said delivery means to enable said glycerophospholipid(s) to be added to the crude oil present in the crude oil flow line comprises a dosing system, especially an injection system, wherein the dosing system is configured to allow controllable addition of said glycerophospholipid(s) to the crude oil. Preferably, said glycerophospholipid(s) is(are) in liquid form and includes an organic solvent, especially an aromatic solvent.

According to an alternative preferred embodiment of the invention where the one or more glycerophospholipid(s) is added to a crude oil stream being transported in a crude oil flow line, said one or more glycerophospholipid(s) is in liquid form, and said delivery means to enable said glycerophospholipid(s) to be added to the crude oil present in the crude oil flow line comprises one or more delivery flow line(s) to allow fluid communication between said glycerophospholipid(s) and said crude oil. More preferably, the delivery means further includes a dosing system, especially an injection system, wherein the dosing system is configured to allow controllable addition of said glycerophospholipid(s) to the crude oil. Preferably, said glycerophospholipid(s) is in liquid form and includes an organic solvent, especially an aromatic solvent.

Suitably, the delivery flow line(s) for delivering the glycerophospholipid(s) to said crude oil include tubing, piping, tubular structures, or a combination thereof.

Unexpectedly, it has been found that it is possible to enhance the capacity of a crude oil to solvate and/or disperse asphaltenes therein by adding an effective amount of said one or more glycerophospholipid(s) to the crude oil.

Further, it has been found that it is possible to increase the solubility and/or dispersibility of asphaltenes in a crude oil by adding an effective amount of said one or more glycerophospholipid(s) to the crude oil.

Further, it has been found that it is possible to reduce the deposition (e.g., precipitation) of asphaltenes from crude oil by adding an effective amount of said one or more glycerophospholipid(s) to the crude oil.

Still further, these technical effects are typically achievable by adding a relatively small quantity of said glycerophospholipid(s) to the crude oil. Suitably, the one or more glycerophospholipid(s) is added to the crude oil in an amount so as to provide the crude oil with a total amount of greater than or equal to 10, preferably greater than or equal to 20, preferably greater than or equal to 30, preferably greater than or equal to 50, ppm by mass of glycerophospholipid(s) on an active ingredient basis, based on the total mass of the crude oil. Suitably, the one or more glycerophospholipid(s) is added to the crude oil in an amount so as to provide the crude oil with a total amount of less than or equal to 10000, preferably less than or equal to 5000, preferably less than or equal to 2000, preferably less than or equal to 1000, ppm by mass of glycerophospholipid(s) on an active ingredient basis, based on the total mass of the crude oil.

By increasing the capacity of crude oil to solvate and/or disperse asphaltenes, and/or increasing the solubility and/or dispersibility of asphaltenes in crude oil, typically inhibits the formation of asphaltene and tar like deposits which may plug and/or restrict oil flow in choke off pipes, safety shut valves, separator equipment, crude oil flow lines, storage vessels, blending equipment and associated transport mechanisms. Advantageously, this may improve crude oil flow characteristics and flow rates but may also mitigate the need, and reduce the frequency, for taking equipment offline and cleaning it mechanically or chemically, thereby reducing lost production time and reducing operating costs. Further, the crude oil which has been/is being recovered typically has more desirable flow characteristics which may translate into an increased rate of production and overall output of the crude oil recovery well.

Thus, in a second aspect, the invention provides the use, of an effective minor amount, of one or more glycerophospholipid(s), as defined herein, as an additive(s) in crude oil to enhance the capacity of the crude oil to solvate and/or disperse asphaltenes in said crude oil.

Thus, in a third aspect, the invention provides the use, of an effective minor amount, of one or more glycerophospholipid(s), as defined herein, as an additive(s) in crude oil to enhance the solubility and/or dispersibility of asphaltenes in said crude oil.

Thus, in a fourth aspect, the invention provides the use, of an effective minor amount, of one or more glycerophospholipid(s), as defined herein, as an additive(s) in crude oil to reduce the deposition (e.g., precipitation) of asphaltenes from crude oil.

Preferably, in the use of the second, third and/or fourth aspect, the use is in the crude oil transportation process as defined according to the first aspect of the invention. Suitably, the one or more glycerophospholipid(s), as defined herein, is added to said crude oil before and/or during the transportation of the crude oil. Suitably, the crude oil is transported by a crude oil flow line (e.g., pipe, tubular structure, pipeline), by road vehicle, by railway vehicle or by watercraft, or a combination thereof. Preferably, the crude oil comprises a crude oil stream transported by a crude oil flow line. More preferably, the crude oil comprises a crude oil stream being transported by a crude oil flow line and said one or more glycerophospholipid(s) is added to the crude oil stream. Suitably, the crude oil stream may comprise crude oil which has been recovered from the crude oil well. Alternatively, or additionally, the crude oil stream may comprise crude oil present in the well bore flow path (e.g., production riser tubing).

Alternatively, or additionally, in the use of the second, third and/or fourth aspect of the invention, the use is in one or more crude oil production or processing operations performed on a crude oil which has been recovered from a crude oil well and before the crude oil is subsequently refined in a petroleum refinery operation, selected from: (i) before and/or during processing of the crude oil, for example, to separate gas and water from the crude oil; (ii) during storage of the crude oil in storage tanks; (iii) before and/or during transportation of the crude oil by crude oil flow line (e.g., pipeline), marine vessel, road vehicle and/or rail vehicle from a crude oil well to a petroleum refinery, and at any intermediate stages thereof en-route to said petroleum refinery; (iv) before and/or during a blending operation including the crude oil (e.g., blending the crude oil with a different type/grade of crude oil); and, (v) upgrading a heavy crude oil to a lighter crude oil, or any combination of (i) to (v).

Further, in the use of the second, third and/or fourth aspect of the invention, the use is in a petroleum refinery operation performed on a refinable petroleum feedstock, such as crude oil or blend of crude oils, and the refinable petroleum feedstock is heated at an elevated temperature during the refinery operation. More preferably, such use is in a petroleum refinery operation performed on a refinable petroleum feedstock, said feedstock is heated at an elevated temperature and said feedstock is in fluid communication with a refinery vessel during the refinery operation, thereby mitigating or preventing asphaltene agglomeration and/or asphaltene precipitation and/or coke formation in the refinery vessel during the refinery operation.

Thus, in a fifth aspect, the invention provides a method for enhancing the capacity of crude oil to solvate and/or disperse asphaltenes in said crude oil during the crude oil transportation process, as defined in accordance with a first aspect of the invention, the method comprising the steps of: (i) adding one or more glycerophospholipid(s), as defined herein, to a crude oil before and/or during the transportation of said crude oil; and, (ii) transporting the crude oil by a crude oil flow line (e.g., pipe, tubular structure, pipeline), by road vehicle, by railway vehicle or by watercraft, or a combination thereof.

Thus, in a sixth aspect, the invention provides a method for enhancing the solubility and/or dispersibility of asphaltenes in crude oil during the crude oil transportation process, as defined in accordance with a first aspect of the invention, the method comprising the steps of: (i) adding one or more glycerophospholipid(s), as defined herein, to a crude oil before and/or during the transportation of said crude oil; and, (ii) transporting the crude oil by a crude oil flow line (e.g., pipe, tubular structure, pipeline), by road vehicle, by railway vehicle or by watercraft, or a combination thereof.

Thus, in a seventh aspect, the invention provides a method for reducing the deposition (e.g., precipitation) of asphaltenes from crude oil during the crude oil transportation process, as defined in accordance with a first aspect of the invention, the method comprising the steps of: (i) adding one or more glycerophospholipid(s), as defined herein, to a crude oil before and/or during the transportation of said crude oil; and, (ii) transporting the crude oil by a crude oil flow line (e.g., pipe, tubular structure, pipeline), by road vehicle, by railway vehicle or by watercraft, or a combination thereof.

In accordance with an eighth aspect, the invention provides a method for enhancing the capacity of crude oil to solvate and/or disperse asphaltenes therein, the method comprising: providing a crude oil which has been recovered from an crude oil well; adding one or more glycerophospholipid(s), as defined herein, to the crude oil during one or more crude oil production or processing operations performed on a crude oil which has been recovered from a crude oil well and before the crude oil is subsequently refined in a petroleum refinery operation, selected from: (i) before and/or during processing of the crude oil, for example, to separate gas and water from the crude oil; (ii) during storage of the crude oil in storage tanks; (iii) before and/or during transportation of the crude oil by crude oil flow line (e.g., pipeline), marine vessel, road vehicle and/or rail vehicle from a crude oil well to a petroleum refinery, and at any intermediate stages thereof en-route to said petroleum refinery; (iv) before and/or during a blending operation including the crude oil (e.g., blending the crude oil with a different type/grade of crude oil); and, (v) upgrading a heavy crude oil to a lighter crude oil, or any combination of (i) to (v).

Thus, in accordance with a ninth aspect, the invention provides a method for enhancing the solubility and/or dispersibility of asphaltenes in a crude oil, the method comprising: providing a crude oil which has been recovered from an crude oil well; adding one or more glycerophospholipid(s), as defined herein, to the crude oil during one or more crude oil production or processing operations performed on a crude oil which has been recovered from a crude oil well and before the crude oil is subsequently refined in a petroleum refinery operation, selected from: (i) before and/or during processing of the crude oil, for example, to separate gas and water from the crude oil; (ii) during storage of the crude oil in storage tanks; (iii) before and/or during transportation of the crude oil by crude oil flow line (e.g., pipeline), marine vessel, road vehicle and/or rail vehicle from a crude oil well to a petroleum refinery, and at any intermediate stages thereof en-route to said petroleum refinery; (iv) before and/or during a blending operation including the crude oil (e.g., blending the crude oil with a different type/grade of crude oil); and, (v) upgrading a heavy crude oil to a lighter crude oil, or any combination of (i) to (v).

Thus, in accordance with a tenth aspect, the invention provides a method for reducing deposition (e.g., precipitation) of asphaltenes from a crude oil, the method comprising: providing a crude oil which has been recovered from an crude oil well; adding one or more glycerophospholipid(s), as defined herein, to the crude oil during one or more crude oil production or processing operations performed on a crude oil, which has been recovered from a crude oil well and before the crude oil is subsequently refined in a petroleum refinery operation, selected from: (i) before and/or during processing of the crude oil, for example, to separate gas and water from the crude oil; (ii) during storage of the crude oil in storage tanks; (iii) before and/or during transportation of the crude oil by crude oil flow line (e.g., pipeline), marine vessel, road vehicle and/or rail vehicle from a crude oil well to a petroleum refinery, and at any intermediate stages thereof en-route to said petroleum refinery; (iv) before and/or during a blending operation including the crude oil (e.g., blending the crude oil with a different type/grade of crude oil); and, (v) upgrading a heavy crude oil to a lighter crude oil, or any combination of (i) to (v).

In accordance with an eleventh aspect, the present invention provides a process for reducing or preventing fouling, especially asphaltene fouling, of a refinery vessel during a petroleum refinery operation of a refinable petroleum feedstock, the process comprising providing a refinable petroleum feedstock in fluid communication with a refinery vessel during a petroleum refinery operation, the refinable petroleum feedstock being at an elevated temperature during the refinery operation, the refinable petroleum feedstock including one or more glycerophospholipid(s), as defined herein.

In accordance with a twelfth aspect, the present invention provides the use, during a petroleum refinery operation of a refinable petroleum feedstock, of an effective minor amount of one or more glycerophospholipid(s), as defined herein, in a refinable petroleum feedstock to reduce and/or prevent fouling, especially asphaltene fouling, of a petroleum refinery vessel by said petroleum feedstock.

Suitably, the process of the eleventh aspect and/or use of the twelfth aspect of the invention each independently may include the step of refining the refinable petroleum feedstock.

In a thirteenth aspect, the invention provides a system for refining a refinable petroleum feedstock, the system comprising: (a) a refinery vessel for refining the refinable petroleum feedstock at an elevated temperature; and (b) a refinable petroleum feedstock in fluid communication with the refinery vessel, wherein the refinable petroleum feedstock includes one or more glycerophospholipid(s), as defined herein.

Suitably, the refinable petroleum feedstock of the eleventh to thirteenth aspects of the invention is at an elevated temperature.

Suitably, the refinable petroleum feedstock as defined in the eleventh to thirteenth aspects has an asphaltene content.

Unexpectedly, it has been found that a significant reduction in fouling, especially asphaltene fouling, of a refinery vessel used to refine a refinable petroleum feedstock during a refinery operation may be achieved by employing an effective minor amount of said one or more glycerophospholipid(s), as defined herein, as an additive for the refinable petroleum feedstock. Further, this technical effect may be achievable by adding a relatively small amount (e.g., 10 to 1000 ppm by mass) of said glycerophospholipid(s) to the refinable petroleum feedstock.

Suitably, the use of a relatively small amount of said glycerophospholipid(s), in a refinable petroleum feedstock typically significantly reduces fouling by the feedstock during a refinery operation, reduces asphaltene agglomeration (or flocculation) and/or asphaltene precipitation in and/or from the feedstock, compared with the refinable petroleum feedstock not including said glycerophospholipid(s), especially when the feedstock is heated at an elevated temperature employed during a petroleum refinery operation.

Advantageously, the use, during a refinery operation of a refinable petroleum feedstock, of said one or more glycerophospholipid(s) as an additive in a refinable petroleum feedstock typically improves the overall efficiency of the refinery operation, increases performance of refinery vessels (e.g., heat transfer equipment) used during the refinery operation, decreases or eliminates scheduled outages for fouling mitigation efforts, and/or reduces energy costs associated with the refinery operation.

Suitably, the refinable petroleum feedstock is at, preferably heated to, an elevated temperature during a refinery operation. The refinable petroleum feedstock may be heated at a number of different points during the refinery operation, for example, in a preheater and/or heat exchanger located up-stream of a desalting unit, in a heater/furnace located upstream of a distillation unit, in a distillation unit, in a cracking unit, in a coking unit. Further, the refinable petroleum feedstock is typically heated at different temperatures in such units. Suitably, the temperature of the refinable petroleum feedstock is typically increased incrementally from the beginning to the end of the refinery operation. Suitably, the refinable petroleum feedstock is heated to an elevated temperature of greater than 40, preferably greater than 60, more preferably greater than 80, even more preferably greater than 100° C., during a refinery operation, for example in a preheater and/or heat exchanger located upstream of a desalting unit. Suitably, the refinable petroleum feedstock is heated to an elevated temperature of greater than 200, preferably greater than 300, more preferably greater than 325° C., during a refinery operation, for example in a heater/furnace located upstream of a distillation unit, particularly such a furnace/heater located downstream of a desalting unit and upstream of a distillation unit, especially an atmospheric distillation unit.

Suitably, in any one of the eleventh to thirteenth aspects of the invention, the refinable petroleum feedstock may be at an elevated temperature of greater than 40° C., preferably greater than 60° C., more preferably greater than 80° C., even more preferably greater than 100° C., even more preferably greater than 120° C. Suitably, in any one of the eighth to tenth aspects of the invention, the refinable petroleum feedstock may be at an elevated temperature of greater than 200, preferably greater than or equal to 300, more preferably greater than or equal to 325° C.

Preferably, the refinable petroleum feedstock, as defined herein and in any one of the eleventh to thirteenth aspects of the invention, comprises a crude oil, a crude oil blend comprising two or more different types of crude oil and fractions obtained from refining a crude oil and a crude oil blend which fractions are further refined in a petroleum refinery operation. Suitably, the crude oil, crude oil blend and fractions obtained therefrom have an asphaltene content.

Suitably, the refinery vessel, as defined herein and in any one of the eleventh to thirteenth aspects of the invention, is selected from one or more of a heat transfer component (e.g., a heat exchanger, a furnace/heater, and/or a preheater), a distillation unit, a catalytic cracking unit, a hydrocracker, a visbreaker, a coker unit, a hydrotreater, a catalytic reformer, an alkylation unit, and said associated process transport mechanisms that are internal to, at least partially constitute, and/or are in direct fluid communication with such components. Preferably, the refinery vessel is selected from one or more of a heat exchanger, a furnace/heater, and/or a preheater and the associated process transport mechanisms that are internal to, at least partially constitute, and/or are in direct fluid communication with such components.

Suitably, in any one of the eleventh to thirteenth aspects of the invention, said one or more glycerophospholipid(s) may be added to the refinable petroleum feedstock before the feedstock reaches the refinery (e.g., during transportation of the feedstock to the refinery and/or during storage of the feedstock before the refinery) and/or when the feedstock is at the refinery.

Suitably, said one or more glycerophospholipid(s) may be added to the refinable petroleum feedstock at the refinery at any stage before the feedstock is refined (e.g., added to the feedstock being stored and/or blended at the refinery, added to the feedstock being transported in a flowline which feeds a refinery process).

Preferably, said one or more glycerophospholipid(s) is added to the petroleum feedstock at a petroleum refinery, especially during a petroleum refinery operation, and at a stage before the feedstock enters a heat transfer component (e.g., a heat exchanger, a furnace/heater, and/or a preheater) for heating the petroleum feedstock during the refinery operation. More preferably, said one or more glycerophospholipid(s) is added to the refinable petroleum feedstock (e.g., crude oil or blend of crude oils) at a petroleum refinery, especially during a petroleum refinery operation, and at one or more stages comprising: (i) before the feedstock enters a preheater located upstream of a desalting unit; (ii) before the feedstock (e.g., crude oil or blend of crude oils) enters a heat exchanger located upstream of a desalting unit; (iii) before the feedstock (e.g., crude oil or blend of crude oils) enters a heater/furnace located downstream of a desalting unit and up-stream of a distillation unit, such as an atmospheric distillation unit.

Suitably, said one or more glycerophospholipid(s) may be present in the refinable petroleum feedstock in an amount of from 1 to 5000, preferably 10 to 2500, more preferably 20 to 2000, most preferably 1 to less than 100, ppm by mass, based on the total mass of the feedstock.

It will be appreciated and understood, that each of the preferred features of the first aspect of the invention may each independently represent preferred features of each of the second to thirteenth aspects of the invention. Further, each of the preferred features of the first aspect of the invention may be combined with one or more preferred features of the first aspect of the invention, and such combination of features may independently represent a preferred combination of feature(s) of each of the second to thirteenth aspects of the invention. Further, each of the preferred features of each aspect of the invention represent preferred features of each and every other aspect of the invention.

DETAILED DESCRIPTION

Definitions

In this specification, the following words and expressions, if and when used, shall have the meanings ascribed below:

"Active ingredients" or "(a.i.)" refers to additive material that is not diluent or solvent;

"comprising" or any cognate word specifies the presence of stated features, steps, or integers or components, but does not preclude the presence or addition of one or more other features, steps, integers, components or groups thereof. The expressions "consists of" or "consists essentially of" or cognates may be embraced within "comprises" or any cognate word. The expression "consists essentially of" permits inclusion of substances not materially affecting the characteristics of the composition to which it applies. The expression "consists of" or cognates means only the stated features, steps, integers components or groups thereof are present to which the expression refers;

"Fouling" generally refers to the accumulation of unwanted materials in a refinery vessel, especially on the surface(s) of the refinery vessel. "Fouling" embraces fouling caused primarily by the presence of variable amounts of organic particulates, especially "asphaltene fouling", or inorganic particulates. Organic particulates include, but are not limited to, insoluble matter precipitated out of the petroleum feedstock (e.g., asphaltenes) when the feedstock is at, suitably heated to, an elevated temperature during a refinery operation. Inorganic particulates include but are not limited to silica, iron oxide, iron sulfide, alkaline earth metal oxides, sodium chloride, calcium chloride and other inorganic salts. One major source of these particulates results from incomplete solids removal during desalting and/or other particulate removing processes. Solids promote the fouling of crude oils, blends and fractions obtained therefrom due to physical effects by modifying the surface area of heat transfer equipment, allowing for longer holdup times at wall temperatures and causing coke formation from asphaltenes and/or crude oil(s). Fouling, especially asphaltene fouling, is measured using the 5 Rod Thermal Deposition Test (5-RTDT);

"Asphaltene fouling" refers to the accumulation of asphaltenes and/or formation of coke particles therefrom, especially asphaltene accumulation, in a refinery vessel, particularly on the surface(s) of the refinery vessel. Asphaltene fouling is generally consequential to asphaltene agglomeration in and/or asphaltene precipitation in and/or from the refinable petroleum feedstock when the feedstock is at an elevated temperature, especially the elevated temperatures employed during a petroleum refinery operation. Thermal degradation of asphaltenes to coke typically occurs due to the relatively high refinery operating temperatures. Asphaltene fouling may also be promoted by the presence of an incomplete removal of inorganic particulates from crude oil, blends and fractions obtained therefrom;

"Petroleum refinery operation" means any process which is, or can be, employed in refining a petroleum feedstock, such as any process employed in an oil refinery operation. Petroleum refining operation embraces any process which is, or can be, employed in refining a crude oil, crude oil blends comprising two or more different crude oils and the further refining of fractions obtained from refining crude oil and crude oil blends. Petroleum refinery operations typically include, but are not limited to, the following processing units, components and/or apparatus: a desalting unit to remove inorganic salts from the feedstock (i.e., crude oil); heat transfer components such as a heat exchanger, a furnace, a crude preheater, a coker preheater, to heat the petroleum feedstock; an atmospheric distillation unit to distill the feedstock (i.e., crude oil) into various fractions; a vacuum distillation unit to further distill the heavy bottom fractions from the atmospheric distillation unit; a catalytic cracking unit (e.g., fluid catalytic cracking unit) to break larger molecules into smaller, lighter hydrocarbon fractions; a catalytic hydrocracking unit to upgrade heavier aromatic and unsaturated fractions from the distillation units to gasoline, jet fuel and gasoil; a visbreaker unit to upgrade the heavy bottom fractions from the vacuum distillation unit by thermally cracking them into lighter hydrocarbon fractions; a coking unit (e.g., delayed coking, fluid coking, flexi-coking unit) to thermally crack very heavy residual oil fractions from the distillation units, especially vacuum distillation unit, to end-products, such as petroleum coke, naptha and diesel oil by-products; a hydrotreater to desulfurize fractions from the distillation units; a catalytic reforming unit to convert desulfurized fractions to higher-octane molecules; an isomerization unit to convert linear molecular fractions into higher-octane branched molecular fractions;

"Refinery vessel" means any component part and/or apparatus of a petroleum refinery operation, such as an oil refinery process, which is in fluid communication with the refinable petroleum feedstock and which is, or can be, susceptible to fouling. Refinery vessels include, but are not limited to, the aforementioned processing units, components and/or apparatus of a "petroleum refinery operation", especially heat transfer components such as a heat exchanger, a furnace, a crude preheater, a coker preheater, or any other heaters, a FCC slurry bottom, a debutanizer exchanger/tower, other feed/effluent exchangers, furnace air preheaters in refinery facilities, flare compressor components, steam cracker/reformer tubes in petrochemical facilities, a fractionation or distillation column, a scrubber, a reactor, a liquid-jacketed tank, a pipestill, a coker, a hydrocracker, a hydrotreater, a catalytic reformer, an isomerization plant, and a visbreaker. It is understood that "refinery vessel", as used herein, encompasses tubes, piping, baffles and other process transport mechanisms that are internal to, at least partially constitute, and/or are in direct fluid communication with, any one of the above-mentioned refinery components;

"Refinable petroleum feedstock" embraces a crude oil, crude oil blends comprising two or more different crude oils, and fractions obtained from refining crude oil and blends thereof which fractions are further refined in a petroleum refinery operation to form a commercial end-product. For example, fractions obtained from refining crude oil which are further refined include, but are not limited to, distillate fractions obtained from an atmospheric crude oil distillation unit which may be further processed, for example, in a hydrotreater, a catalytic reformer, and/or an isomerization unit; atmospheric gas oil obtained from an atmospheric crude oil distillation unit which may be further processed, for example, in a hydrotreater and catalytic converter; atmospheric bottoms (heavy residua) from an atmospheric crude oil distillation unit which are used as feedstock for a vacuum distillation unit; vacuum gas oil obtained from a vacuum distillation unit which may be subjected to catalytic cracking and/or hydrocracking; bottom products from a vacuum distillation unit which are used as feedstock of a visbreaker and coking unit. The term "refinable petroleum feedstock" does not include the ultimate refined commercial end-products of the petroleum refinery operation which are not subjected to a further refining operation, such as gasoline and diesel fuels, light and heavy naphtha, kerosene, heavy fuel oils, and lubricating oils;

"Refinable petroleum feedstock having an asphaltene content" means a refinable petroleum feedstock, as defined herein, which includes asphaltenes;

"Crude oil" means the hydrocarbon fossil fuel oil located underground which is extracted and refined in a petroleum refinery operation at a petroleum refinery to produce ultimate refined commercial end-products, such as gasoline and diesel fuels, light and heavy naphtha, kerosene, heavy fuel oils, and lubricating oils. The term "crude oil" includes any crude oil which has not been refined to produce such commercial end products. For example, the term "crude oil" embraces a single type of crude oil, a crude oil blend comprising two or more different types of crude oil, or an upgraded crude oil (e.g., where a heavy grade crude oil is converted to a lighter grade crude oil, the lighter grade crude oil being subsequently refined to produce the commercial end products). Crude oil embraces intermediate (light) crude oils, medium crude oils, heavy crude oils and shale oils;

"Crude oil having an asphaltene content" means a crude oil, as defined herein, which includes asphaltenes;

"Capacity of a crude oil to solvate and/or disperse asphaltenes" means the ability of a crude oil to solvate and/or disperse asphaltenes. The capacity and enhanced capacity of a crude oil to solvate and/or disperse asphaltenes is assessed by the crude oil asphaltene stability test as described herein;

"Enhancing the capacity of a crude oil to solvate and/or disperse asphaltenes" means increasing the ability of a crude oil to solvate and/or disperse asphaltenes when such ability is reduced upon pressure changes, temperature changes, compositional or other mechanical or physical processing operations of the crude oil (e.g., forming a crude oil blend from two or more different types of crude oil). The enhanced capacity may permit increased amounts of asphaltenes to be solvated and/or dispersed in a crude oil. Alternatively, or additionally, the enhanced capacity may permit formation of a crude oil, or formation of a crude oil blend, having a defined asphaltene content wherein the asphaltenes are more stably solvated and/or dispersed (i.e., asphaltene precipitation from and/or agglomeration in the crude oil is reduced);

"Capacity of a refinable petroleum feedstock to solvate and/or disperse asphaltenes" and "Enhancing the capacity of a refinable petroleum feedstock to solvate and/or disperse asphaltenes" means that capacity or enhanced capacity with reference to a refinable petroleum feedstock, as defined herein, and is otherwise defined as "the capacity or enhanced capacity of a crude oil to solvate and/or disperse asphaltenes";

"Increasing the solubility and/or dispersibility of asphaltenes in a crude oil" means increasing the solubility and/or dispersibility of asphaltenes in a crude oil when such solubility and/or dispersibility is reduced upon pressure changes, temperature changes, compositional or other mechanical or physical processing operations of the crude oil (e.g., forming a crude oil blend from two or more different types of crude oil). The increased solubility and/or dispersibility is assessed by the crude oil asphaltene dispersancy test as described herein;

"Increasing the solubility and/or dispersibility of asphaltenes in a refinable petroleum feedstock" means increasing the solubility and/or dispersibility of asphaltenes with reference to a refinable petroleum feedstock, as defined herein, and is otherwise defined as "increasing the solubility and/or dispersibility of asphaltenes in a crude oil";

"Reducing the deposition (e.g., precipitation) of asphaltenes from a crude oil" means reducing the deposition of asphaltenes from a crude oil when such deposition is increased upon pressure changes, temperature changes, compositional or other mechanical or physical processing operations of the crude oil (e.g., forming a crude oil blend from two or more different types of crude oil). The reduced deposition of asphaltenes from crude oil may be measured using the 5 Rod Thermal Deposition Test (5-RTDT);

"Reducing the deposition of asphaltenes from a refinable petroleum feedstock" means reducing the deposition of asphaltenes with reference to a refinable petroleum feedstock, as defined herein, and is otherwise defined as "reducing the deposition of asphaltenes from a crude oil";

"Hydrocarbon fluid" means a hydrocarbon liquid or oil which is not a crude oil;

"Hydrocarbyl group" means a univalent radical that contains hydrogen and carbon atoms only, save for any atom other than carbon or hydrogen which is bonded to the carbon atom which bonds the hydrocarbyl group to the remainder of the compound. The hydrocarbyl group is bonded to the remainder of the compound directly via a single carbon atom or a single acyl group. The term "hydrocarbyl group" therefore includes "alkyl", "alkylacyl", "alkenyl", "alkenylacyl" groups as defined herein. Preferably, the hydrocarbyl group, including the carbon atom of any acyl group which may be present, is a $C_{10}$ to $C_{30}$, preferably $C_{12}$ to $C_{28}$, more preferably $C_{12}$ to $C_{26}$, more preferably Cu to $C_{24}$, more preferably $C_{14}$ to $C_{22}$, more preferably $C_{16}$ to $C_{22}$, more preferably $C_{16}$ to $C_{20}$, most preferably $C_{16}$ to $C_{18}$ hydrocarbyl group. The hydrocarbyl group may be branched or straight chain, and it may include one or more carbon-to-carbon double bonds. Preferably, the hydrocarbyl group is an acyclic aliphatic hydrocarbyl group. Most preferred hydrocarbyl groups are alkylacyl and alkenylacyl groups, preferably acyclic aliphatic alkylacyl and acyclic aliphatic alkenylacyl groups, where the hydrocarbyl group is bonded to the remainder of the compound via a single acyl group and said alkylacyl and alkenylacyl groups, including the carbon atom of the acyl group, have a total number of carbon atoms as defined in respect of a "hydrocarbyl group";

"Alkyl group" means a univalent alkyl radical (i.e., a monovalent hydrocarbon group containing no double or triple bonds) which is bonded to the remainder of the compound directly via a single carbon atom. Preferably, the alkyl group is an acyclic alkyl group, more preferably an acyclic aliphatic alkyl group. Preferably, the alkyl group is a $C_{10}$ to $C_{30}$, preferably $C_{12}$ to $C_{28}$, more preferably $C_{12}$ to $C_{26}$, more preferably $C_{12}$ to $C_{24}$, more preferably $C_{14}$ to $C_{22}$, more preferably $C_{16}$ to $C_{22}$, more preferably $C_{16}$ to $C_{20}$, most preferably $C_{16}$ to $C_{18}$ alkyl group;

"Alkenyl group" means a monovalent hydrocarbon radical which includes one or more carbon-to-carbon double bonds, preferably 1 to 3 carbon-to-carbon double bonds, and is bonded to the remainder of the compound directly via a single carbon atom. Preferably, the alkenyl group is an acyclic alkenyl group, more preferably an acyclic aliphatic alkenyl group. Preferably, the alkenyl group is a $C_{10}$ to $C_{30}$, preferably $C_{12}$ to $C_{28}$, more preferably Cu to $C_{26}$, more preferably $C_{12}$ to $C_{24}$, more preferably $C_{14}$ to $C_{22}$, more preferably $C_{16}$ to $C_{22}$, more preferably $C_{16}$ to $C_{20}$, most preferably $C_{16}$ to $C_{18}$ alkenyl group;

"Acyl group" means a monovalent hydrocarbon radical, which is bonded to the remainder of the compound directly by an acyl group (i.e., C═O group);

"Alkylacyl group" means an alkyl group, as defined herein, which is bonded to the remainder of the compound directly by an acyl group, as defined herein. Preferably, the alkylacyl group, including the carbon atom of the acyl group, is a $C_{10}$ to $C_{30}$, preferably $C_{12}$ to $C_{28}$, more preferably $C_{12}$ to $C_{26}$, more preferably $C_{12}$ to $C_{24}$, more preferably $C_{14}$ to $C_{22}$, more preferably $C_{16}$ to $C_{22}$, more preferably $C_{16}$ to $C_{20}$, most preferably $C_{16}$ to $C_{18}$ alkylacyl group;

"Alkenylacyl group" means an alkenyl group, as defined herein, which is bonded to the remainder of the compound directly by an acyl group, as defined herein. Preferably, the alkenylacyl group, including the carbon atom of the acyl group, is a $C_{10}$ to $C_{30}$, preferably $C_{12}$ to $C_{28}$, more preferably $C_{12}$ to $C_{26}$, more preferably $C_{12}$ to $C_{24}$, more preferably $C_{14}$ to $C_{22}$, more preferably $C_{16}$ to $C_{22}$, more preferably $C_{16}$ to $C_{20}$, most preferably $C_{16}$ to $C_{18}$ alkenylacyl group;

"Lecithin" is a generic term and means a mixture of fatty substances comprising glycerophospholipids, such as glycerophosphocholines, glycerophosphoethanolamines, glycerophosphoinositols, other phospholipids such as sphingosylphospholipids, fatty acids, triglycerides, sterols, carbohydrates and/or glycolipids. Lecithins may be obtained from animal, plant or microbial sources;

"Glycerophospholipid" means any derivative of glycerophosphoric acid which also includes at least one O-acyl, O-alkyl, or O-alkenyl (e.g., O-1-alkenyl) group attached to the glycerol unit. Examples of glycerophospholipid(s) include glycerophosphocholines, glycerophosphoethanolamines, glycerophosphoinositols, glycerophospho serines where the glycerol unit includes at least one, preferably two, O-acyl, O-alkyl, or O-alkenyl group(s). Preferred glycerophospholipids include glycerophosphocholines, glycerophosphoethanolamines, and the zwitterionic salts thereof;

"Oil-soluble" or "oil-dispersible", or cognate terms, used herein do not necessarily indicate that the compounds or additives are soluble, dissolvable, miscible, or are capable of being suspended in a crude oil in all proportions. These do mean, however, that said one or more glycerophospholipid(s) are, for example, soluble or stably dispersible in a crude oil, or a refinable petroleum feedstock, to an extent sufficient to exert their intended effect. Moreover, the additional incorporation of other additives may also permit incorporation of higher levels of a particular additive(s), if desired;

"Major amount" means in excess of 50 mass %, preferably 60 mass % or more, more preferably 70 mass % or more, even more preferably 80 mass % or more, of the stated component(s) and in respect of the total mass of the composition, reckoned as active ingredient of the component(s);

"Minor amount" means less than 50 mass %, preferably less than or equal to 40 mass %, more preferably less than or equal to 30 mass %, even more preferably less than or equal to 20 mass %, of the stated component(s) and in respect of the total mass of the composition, reckoned as active ingredient of the component(s);

"Effective amount" in respect of an additive, or combination of additives, means an amount of such additive(s) in a composition that is effective to provide, and provides, the desired technical effect;

"ppm" means parts per million by mass, based on the total mass of the composition.

All percentages reported are mass % on an active ingredient basis, i.e., without regard to carrier or diluent oil, unless otherwise stated.

Also, it will be understood that various components used, essential as well as optimal and customary, may react under conditions of formulation, storage or use and that the invention also provides the product obtainable or obtained as a result of any such reaction.

Further, it is understood that any upper and lower quantity, range and ratio limits set forth herein may be independently combined. Accordingly, any upper and lower quantity, range and ratio limits set forth herein associated with a particular technical feature of the present invention may be independently combined with any upper and lower quantity, range and ratio limits set forth herein associated with one or more other particular technical feature(s) of the present invention. Furthermore, any particular technical feature of the present invention, and all preferred variants thereof, may be independently combined with any other particular technical feature(s), and all preferred variants thereof, irrespective of whether such features are presented as preferred or not.

Also, it will be understood that the preferred features of each aspect of the present invention are regarded as preferred features of each and every aspect of the present invention.

Glycerophospholipid(s)

The one or more glycerophospholipid(s) which may be employed in each and every aspect of the present invention are as detailed herein.

The one or more glycerophospholipid(s) which are used in each aspect of the invention are present in and obtainable from lecithin(s). Lecithin(s) comprises a mixture of glycerophospholipids, such as glycerophosphocholines, glycerophosphoethanolamines, glycerophosphoinositols, other phospholipids such as sphingosylphospholipids, fatty acids, triglycerides, sterols, carbohydrates and glycolipids. Lecithin(s) may be obtained from animal, plant or microbial sources. Lecithin(s) may be obtained from plants, such as soybean, cottonseed, corn, sunflower, rapeseed, including the genetically modified versions thereof, and animal sources, such as egg yolk, marine organisms and bovine brain. Lecithin(s) may be obtained from these sources by techniques well known to those skilled in the art, for example water degumming of extracted oil seeds, or by using solvents such as hexane, ethanol, acetone. Lecithin(s) from various sources are commercially available in either unrefined form or a refined form (i.e., a de-oiled form). It is also possible to identify the types and determine the relative amounts of the component parts of lecithin by routine experimental techniques, for example, using phosphorous NMR spectroscopy (31P NMR). Further, it is also possible to isolate the different types of glycerophospholipids present in lecithin by routine experimental techniques, and it is possible to synthesise glycerophospholipids.

Suitably, said one or more glycerophospholipid(s) may be in solid form (e.g., particulates, powder) or liquid form, such as, for example, a solution, dispersion, suspension, or emulsion. Preferably, said lecithin(s) is in liquid form, more preferably liquid form including an organic solvent, especially an aromatic organic solvent.

Unexpectedly, it has been found that if said one or more glycerophospholipid(s) is selected from one or more bis-($C_{10}$ to $C_{30}$ hydrocarbyl)glycerophosphocholine(s), as defined herein, one or more bis-($C_{10}$ to $C_{30}$ hydrocarbyl) glycerophosphoethanolamine(s), as defined herein, or a combination of said bis-($C_{10}$ to $C_{30}$ hydrocarbyl)glycerophosphocholine(s) and bis-($C_{10}$ to $C_{30}$ hydrocarbyl)glycerophosphoethanolamine(s), then this typically significantly enhances the capacity of a crude oil, or a refinable petroleum feedstock, to solvate and/or disperse asphaltenes therein, and/or further increases the solubility and/or dispersibility of asphaltenes in a crude oil, or in a refinable petroleum feedstock, and/or further reduces the precipitation of asphaltenes from a crude oil or a refinable petroleum feedstock.

Suitably, the enhancement of the capacity of a crude oil, or a refinable petroleum feedstock, to solvate and/or disperse asphaltenes therein, and/or increase in the solubility and/or dispersibility of asphaltenes in a crude oil/refinable petroleum feedstock, and/or reduction in precipitation of asphaltenes from a crude oil/refinable petroleum feedstock, by the use of said one or more bis-(hydrocarbyl)glycerophosphocholine(s) and/or said one or more bis-(hydrocarbyl)glycerophosphoethanolamine(s), is observable compared to the use of other different types of glycerophospholipid(s), especially the use of the corresponding mono-substituted ($C_{10}$ to $C_{30}$ hydrocarbyl)glycerophosphocholine(s) and/or mono-substituted ($C_{10}$ to $C_{30}$ hydrocarbyl)glycerophosphoethanolamine(s) (i.e., compared to the corresponding lyso-derivatives of said bis-($C_{10}$ to $C_{30}$ hydrocarbyl)glycerophosphocholine(s) and bis-($C_{10}$ to $C_{30}$ hydrocarbyl)glycerophosphoethanolamine(s)).

Suitably, the enhancement of the capacity of a crude oil, or refinable petroleum feedstock, to solvate and/or disperse asphaltenes therein, and/or increase the solubility and/or dispersibility of asphaltenes in a crude oil/refinable petroleum feedstock, and/or reduction in precipitation of asphaltenes from a crude oil/refinable petroleum feedstock, by the use of said bis-(hydrocarbyl)glycerophosphocholine(s) and/or said bis-(hydrocarbyl)glycerophosphoethanolamine(s), is noticeable compared to the use of other bis-(hydrocarbyl)glycerophospholipid(s), such as bis-($C_{10}$ to $C_{30}$ hydrocarbyl)glycerophosphoinositol(s).

Thus, according to a preferred aspect of each of the first to thirteenth aspects of the invention, said one or more glycerophospholipid(s) is selected from: one or more bis-($C_{10}$ to $C_{30}$ hydrocarbyl)glycerophosphocholine(s), as defined herein; one or more bis-($C_{10}$ to $C_{30}$ hydrocarbyl) glycerophosphoethanolamine(s), as defined herein; or a combination of said bis-($C_{10}$ to $C_{30}$ hydrocarbyl)glycerophosphocholine(s) and bis-($C_{10}$ to $C_{30}$ hydrocarbyl)glycerophosphoethanolamine(s).

More preferably, said one or more glycerophospholipid(s) comprises one or more bis-($C_{10}$ to $C_{30}$ hydrocarbyl)glycerophosphocholine(s), as defined herein.

Suitably, said one or more bis-($C_{10}$ to $C_{30}$ hydrocarbyl) glycerophosphocholine(s) comprises one or more bis-($C_{12}$ to $C_{26}$ hydrocarbyl)glycerophosphocholine(s), preferably one or more bis-($C_{12}$ to $C_{24}$ hydrocarbyl)glycerophosphocholine(s), preferably one or more bis-($C_{14}$ to $C_{22}$ hydrocarbyl)glycerophosphocholine(s), more preferably one or more bis-($C_{16}$ to $C_{22}$ hydrocarbyl)glycerophosphocholine(s), more preferably one or more bis-($c_{16}$ to $C_{20}$ hydrocarbyl) glycerophosphocholine(s), most preferably one or more bis-($C_{16}$ to $C_{18}$ hydrocarbyl)glycerophosphocholine(s).

Suitably, said one or more bis-($C_{10}$ to $C_{30}$ hydrocarbyl) glycerophosphocholine(s), as defined herein, may each independently include two hydrocarbyl groups having the same number of carbon atoms or each independently include two hydrocarbyl groups having a different number of carbon atoms.

Suitably, each hydrocarbyl group of said one or more bis-($C_{10}$ to $C_{30}$ hydrocarbyl)glycerophosphocholine(s), as defined herein, may independently, at each occurrence, be saturated or unsaturated (e.g., contain one or more carbon-to-carbon double bonds). Preferably, at least one of the hydrocarbyl groups of said one or more bis-($C_{10}$ to $C_{30}$ hydrocarbyl)glycerophosphocholine(s), as defined herein, is unsaturated and includes at least one carbon-to-carbon double bond. More preferably, each of said hydrocarbyl groups of said one or more bis-($C_{10}$ to $C_{30}$ hydrocarbyl) glycerophosphocholine(s), as defined herein, is unsaturated and includes at least one carbon-to-carbon double bond.

Suitably, each hydrocarbyl group of said one or more bis-($C_{10}$ to $C_{30}$ hydrocarbyl)glycerophosphocholine(s), as defined herein, independently represents, at each occurrence, an aliphatic $C_{10}$ to $C_{30}$ alkylacyl group, an aliphatic $C_{10}$ to $C_{30}$ alkenylacyl group, a $C_{10}$ to $C_{30}$ alkyl group or a $C_{10}$ to $C_{30}$ alkenyl group, wherein each of said alkyl or alkenyl groups may independently be linear or branched. Preferably, each hydrocarbyl group of said one or more bis-($C_{10}$ to $C_{30}$ hydrocarbyl)glycerophosphocholine(s), independently represents, at each occurrence, an aliphatic $C_{10}$ to $C_{30}$ alkylacyl group or an aliphatic $C_{10}$ to $C_{30}$ alkenylacyl group, as defined herein.

Suitably, each of said aliphatic $C_{10}$ to $C_{30}$ alkylacyl group(s), aliphatic $C_{10}$ to $C_{30}$ alkenylacyl group(s), $C_{10}$ to $C_{30}$ alkyl group(s) or $C_{10}$ to $C_{30}$ alkenyl group(s) of said one or more bis-($C_{10}$ to $C_{30}$ hydrocarbyl)glycerophosphocholine(s) is acyclic, preferably aliphatic and acyclic.

Preferably, at least one hydrocarbyl group of said one or more bis-($C_{10}$ to $C_{30}$ hydrocarbyl)glycerophosphocholine(s) independently represents an aliphatic $C_{10}$ to $C_{30}$ alkylacyl group or aliphatic $C_{10}$ to $C_{30}$ alkenylacyl group, as defined herein, especially an aliphatic $C_{10}$ to $C_{30}$ alkenylacyl group. More preferably, each hydrocarbyl group of said one or more bis-($C_{10}$ to $C_{30}$ hydrocarbyl)glycerophosphocholine(s) independently represents an aliphatic $C_{10}$ to $C_{30}$ alkylacyl group or aliphatic $C_{10}$ to $C_{30}$ alkenylacyl group, as defined herein. Even more preferably, each hydrocarbyl group of said one or more bis-($C_{10}$ to $C_{30}$ hydrocarbyl)glycerophosphocholine(s) independently represents an aliphatic $C_{10}$ to $C_{30}$ alkenylacyl group, as defined herein.

Suitably, each of said aliphatic $C_{10}$ to $C_{30}$ alkylacyl group(s) may independently comprise a $C_{10}$ to $C_{30}$, preferably $C_{12}$ to $C_{28}$, more preferably Cu to $C_{24}$, more preferably $C_{14}$ to $C_{22}$, more preferably $C_{16}$ to $C_{22}$, more preferably $C_{16}$ to $C_{20}$, most preferably $C_{16}$ to $C_{18}$ alkylacyl group, where the total number of carbon atoms includes the carbon atom of the acyl group which bonds the group(s) to the remainder of the compound. Suitably, the alkylacyl group is aliphatic and acyclic.

Suitably, each of said aliphatic $C_{10}$ to $C_{30}$ alkenylacyl group(s) may independently comprise a $C_{10}$ to $C_{30}$, preferably $C_{12}$ to $C_{28}$, more preferably $C_{12}$ to $C_{24}$, more preferably $C_{14}$ to $C_{22}$, more preferably $C_{16}$ to $C_{22}$, more preferably $C_{16}$ to $C_{20}$, most preferably $C_{16}$ to $C_{18}$ alkenylacyl group, where the total number of carbon atoms includes the carbon atom of the acyl group which bonds the group(s) to the remainder of the compound. Suitably, the alkenylacyl group is aliphatic and acyclic.

Thus, according to a preferred aspect of each of the first to thirteenth aspects of the invention, said one or more bis-($C_{10}$ to $C_{30}$ hydrocarbyl)glycerophosphocholine(s) represents one or more bis-(aliphatic $C_{10}$ to $C_{30}$ alkylacyl) glycerophosphocholine(s), as defined herein, one or more bis-(aliphatic $C_{10}$ to $C_{30}$ alkenylacyl)glycerophosphocholine(s), as defined herein, or one or more (aliphatic $C_{10}$ to $C_{30}$ alkenylacyl), (aliphatic $C_{10}$ to $C_{30}$ alkylacyl)glycerophosphocholine(s), as defined herein, preferably one or more bis-(aliphatic $C_{10}$ to $C_{30}$ alkenylacyl)glycerophosphocholine(s).

Suitably, said one or more bis-(aliphatic $C_{10}$ to $C_{30}$ alkenylacyl)glycerophosphocholine(s), as defined herein, comprises one or more bis-(aliphatic $C_{12}$ to $C_{26}$ alkenylacyl) glycerophosphocholine(s), more preferably one or more bis-(aliphatic $C_{12}$ to $C_{24}$ alkenylacyl)glycerophosphocholine(s), more preferably one or more bis-(aliphatic $C_{14}$ to $C_{22}$ alkenylacyl)glycerophosphocholine(s), more preferably one or more bis-(aliphatic $C_{16}$ to $C_{22}$ alkenylacyl)glycerophosphocholine(s), more preferably one or more bis-(aliphatic $C_{16}$ to $C_{20}$ alkenylacyl)glycerophosphocholine(s), more preferably one or more bis-(aliphatic $C_{16}$ to $C_{18}$ alkenylacyl)glycerophosphocholine(s).

Suitably, said one or more bis-($C_{10}$ to $C_{30}$ hydrocarbyl) glycerophosphoethanolamine(s) comprises one or more bis-($C_{12}$ to $C_{26}$ hydrocarbyl)glycerophosphoethanolamine(s), preferably one or more bis-($C_{12}$ to $C_{24}$ hydrocarbyl)glycerophosphoethanolamine(s), preferably one or more bis-($C_{14}$ to $C_{22}$ hydrocarbyl)glycerophosphoethanolamine(s), more preferably one or more bis-($C_{16}$ to $C_{22}$ hydrocarbyl)glycerophosphoethanolamine(s), more preferably one or more bis-($C_{16}$ to $C_{20}$ hydrocarbyl)glycerophosphoethanolamine(s), most preferably one or more bis-($C_{16}$ to $C_{18}$ hydrocarbyl) glycerophosphoethanolamine(s).

Suitably, said one or more bis-($C_{10}$ to $C_{30}$ hydrocarbyl) glycerophosphoethanolamine(s), as defined herein, may each independently include two hydrocarbyl groups having the same number of carbon atoms or each independently include two hydrocarbyl groups having a different number of carbon atoms.

Suitably, each hydrocarbyl group of said one or more bis-($C_{10}$ to $C_{30}$ hydrocarbyl)glycerophosphoethanolamine(s), as defined herein, may independently, at each occurrence, be saturated or unsaturated (e.g., contain one or more carbon-to-carbon double bonds). Preferably, at least one of the hydrocarbyl groups of said one or more bis-($C_{10}$ to $C_{30}$ hydrocarbyl)glycerophosphoethanolamine(s), as defined herein, is unsaturated and includes at least one carbon-to-carbon double bond. More preferably, each of said hydrocarbyl groups of said one or more bis-($C_{10}$ to $C_{30}$ hydrocarbyl)glycerophosphoethanolamine(s), as defined herein, is unsaturated and includes at least one carbon-to-carbon double bond.

Suitably, each hydrocarbyl group of said one or more bis-($C_{10}$ to $C_{30}$ hydrocarbyl)glycerophosphoethanolamine(s), as defined herein, independently represents, at each occurrence, an aliphatic $C_{10}$ to $C_{30}$ alkylacyl group, an aliphatic $C_{10}$ to $C_{30}$ alkenylacyl group, a $C_{10}$ to $C_{30}$ alkyl group or a $C_{10}$ to $C_{30}$ alkenyl group, wherein each of said alkyl or alkenyl groups may independently be linear or branched. Preferably, each hydrocarbyl group of said one or more bis-($C_{10}$ to $C_{30}$ hydrocarbyl)glycerophosphoethanolamine(s), independently represents, at each occurrence, an aliphatic $C_{10}$ to $C_{30}$ alkylacyl group or an aliphatic $C_{10}$ to $C_{30}$ alkenylacyl group, as defined herein.

Suitably, each of said aliphatic $C_{10}$ to $C_{30}$ alkylacyl group(s), aliphatic $C_{10}$ to $C_{30}$ alkenylacyl group(s), $C_{10}$ to $C_{30}$ alkyl group(s) or $C_{10}$ to $C_{30}$ alkenyl group(s) of said one or more bis-($C_{10}$ to $C_{30}$ hydrocarbyl) glycerophosphoethanolamine(s) is acyclic, preferably aliphatic and acyclic.

Preferably, at least one hydrocarbyl group of said one or more bis-($C_{10}$ to $C_{30}$ hydrocarbyl) glycerophosphoethanolamine(s) independently represents an aliphatic $C_{10}$ to $C_{30}$ alkylacyl group or aliphatic $C_{10}$ to $C_{30}$ alkenylacyl group, as defined herein, especially an aliphatic $C_{10}$ to $C_{30}$ alkenylacyl group. More preferably, each hydrocarbyl group of said one or more bis-($C_{10}$ to $C_{30}$ hydrocarbyl) glycerophosphoethanolamine(s) independently represents an aliphatic $C_{10}$ to $C_{30}$ alkylacyl group or aliphatic $C_{10}$ to $C_{30}$ alkenylacyl group, as defined herein. Even more preferably, each hydrocarbyl group of said one or more bis-($C_{10}$ to $C_{30}$ hydrocarbyl) glycerophosphoethanolamine(s) independently represents an aliphatic $C_{10}$ to $C_{30}$ alkenylacyl group, as defined herein.

Suitably, each of said aliphatic $C_{10}$ to $C_{30}$ alkylacyl group(s) may independently comprise a $C_{10}$ to $C_{30}$, preferably $C_{12}$ to $C_{28}$, more preferably $C_{12}$ to $C_{24}$, more preferably $C_{14}$ to $C_{22}$, more preferably $C_{16}$ to $C_{22}$, more preferably $C_{16}$ to $C_{20}$, most preferably $C_{16}$ to $C_{18}$ alkylacyl group, where the total number of carbon atoms includes the carbon atom of the acyl group which bonds the group(s) to the remainder of the compound. Suitably, the alkylacyl group is aliphatic and acyclic.

Suitably, each of said aliphatic $C_{10}$ to $C_{30}$ alkenylacyl group(s) may independently comprise a $C_{10}$ to $C_{30}$, preferably $C_{12}$ to $C_{28}$, more preferably Cu to $C_{24}$, more preferably $C_{14}$ to $C_{22}$, more preferably $C_{16}$ to $C_{22}$, more preferably $C_{16}$ to $C_{20}$, most preferably $C_{16}$ to $C_{18}$ alkenylacyl group, where the total number of carbon atoms includes the carbon atom of the acyl group which bonds the group(s) to the remainder of the compound. Suitably, the alkenylacyl group is aliphatic and acyclic.

Thus, according to a preferred aspect of each of the first to thirteenth aspects of the invention, said one or more bis-($C_{10}$ to $C_{30}$ hydrocarbyl)glycerophosphoethanolamine(s) represents one or more bis-(aliphatic $C_{10}$ to $C_{30}$ alkylacyl) glycerophosphoethanolamine(s), as defined herein, one or more bis-(aliphatic $C_{10}$ to $C_{30}$ alkenylacyl)glycerophosphoethanolamine(s), as defined herein, or one or more (aliphatic $C_{10}$ to $C_{30}$ alkenylacyl), (aliphatic $C_{10}$ to $C_{30}$ alkylacyl) glycerophosphoethanolamine(s), as defined herein, preferably one or more bis-(aliphatic $C_{10}$ to $C_{30}$ alkenylacyl) glycerophosphoethanolamine(s).

Suitably, said one or more bis-(aliphatic $C_{10}$ to $C_{30}$ alkenylacyl) glycerophosphoethanolamine(s), as defined herein, comprises one or more bis-(aliphatic $C_{12}$ to $C_{26}$ alkenylacyl)glycerophosphoethanolamine(s), more preferably one or more bis-(aliphatic Cu to $C_{24}$ alkenylacyl) glycerophosphoethanolamine(s), more preferably one or more bis-(aliphatic $C_{14}$ to $C_{22}$ alkenylacyl)glycerophosphoethanolamine(s), more preferably one or more bis-(aliphatic $C_{16}$ to $C_{22}$ alkenylacyl)glycerophosphoethanolamine(s), more preferably one or more bis-(aliphatic $C_{16}$ to $C_{20}$ alkenylacyl)glycerophosphoethanolamine(s), more preferably one or more bis-(aliphatic $C_{16}$ to $C_{18}$ alkenylacyl) glycerophosphoethanolamine(s).

Preferably, the one or more glycerophospholipid(s) comprises one or more bis-($C_{10}$ to $C_{30}$ hydrocarbyl)glycerophosphocholine(s), as defined herein, in each of the first to thirteenth aspects of the invention.

Suitably, said one or more glycerophospholipid(s) may be represented by one or more compounds of Formula I or the zwitterionic salt thereof:

I

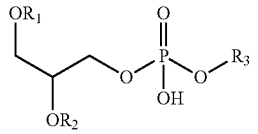

wherein: $R_1$ and $R_2$ each independently represent hydrogen or a $C_{10}$ to $C_{30}$ hydrocarbyl group, as defined herein;

$R_3$ is selected from —$CH_2CH_2NH_2$, —$CH_2CH_2N^+(CH_3)_3$, —$CH_2CH(NH_2)CO_2H$, or inositol; and, with the proviso that $R_1$ and $R_2$ do not both represent hydrogen.

Preferably $R_3$, in a compound of Formula I or the zwitterionic salt thereof, represents —$CH_2CH_2NH_2$ (ethanolamine) or —$CH_2CH_2N^+(CH_3)_3$ (choline), especially —$CH_2CH_2N^+(CH_3)_3$ (choline).

Preferably, $R_1$ and $R_2$, in a compound of Formula I or the zwitterionic salt thereof, each independently represent a $C_{10}$ to $C_{30}$ hydrocarbyl group, as defined herein.

More preferably, $R_1$ and $R_2$, in a compound of Formula I or the zwitterionic salt thereof, each independently represent an aliphatic $C_{10}$ to $C_{30}$ alkenylacyl group as defined herein, an aliphatic $C_{10}$ to $C_{30}$ alkylacyl group as defined herein, a $C_{10}$ to $C_{30}$ alkyl group as defined herein, or a $C_{10}$ to $C_{30}$ alkenyl group as defined herein, especially an aliphatic $C_{10}$ to $C_{30}$ alkenylacyl group or an aliphatic $C_{10}$ to $C_{30}$ alkylacyl group as defined herein.

Suitably, in each of the first to thirteenth aspects of the invention, said one or more glycerophospholipid(s), as defined herein, especially said one or more bis-($C_{10}$ to $C_{30}$ hydrocarbyl)glycerophosphopholipid(s), is added to crude oil or a refinable petroleum feedstock, respectively, in an amount of greater than or equal to 10, preferably greater than or equal to 20, preferably greater than or equal to 30, preferably greater than or equal to 50, ppm by mass on an active ingredient basis, based on the total mass of the crude oil and refinable petroleum feedstock, respectively.

Suitably, in each of the first to thirteenth aspects of the invention, said one or more glycerophospholipid(s), as defined herein, especially said one or more bis-($C_{10}$ to $C_{30}$ hydrocarbyl)glycerophosphopholipid(s), is added to crude oil or refinable petroleum feedstock, respectively, in an amount of less than or equal to 10000, preferably less than or equal to 5000, preferably less than or equal to 2000, preferably less than or equal to 1000, ppm by mass on an active ingredient basis, based on the total mass of the crude oil and refinable petroleum feedstock, respectively.

Suitably, in each of the first to thirteenth aspects of the invention, said one or more bis-(hydrocarbyl)glycerophosphocholine(s), as defined herein, is added to crude oil or a refinable petroleum feedstock, respectively, in an amount of greater than or equal to 10, preferably greater than or equal to 20, preferably greater than or equal to 30, preferably greater than or equal to 40, preferably greater than or equal to 50, ppm by mass on an active ingredient basis, based on the total mass of the crude oil and refinable petroleum feedstock, respectively.

Suitably, each of the first to thirteenth aspects of the invention, said one or more bis-(hydrocarbyl)glycerophosphocholine(s), as defined herein, is added to crude oil or refinable petroleum feedstock, respectively, in an amount of less than or equal to 10000, preferably less than or equal to 5000, preferably less than or equal to 2000, preferably less than or equal to 1500, ppm by mass on an active ingredient basis, based on the total mass of the crude oil and refinable petroleum feedstock, respectively.

Suitably, in each of the first to thirteenth aspects of the invention, said one or more bis-(hydrocarbyl)glycerophosphoethanolamine(s), as defined herein, is added to crude oil or a refinable petroleum feedstock, respectively, in an amount of greater than or equal to 10, preferably greater than or equal to 20, preferably greater than or equal to 25, preferably greater than or equal to 30, ppm by mass on an active ingredient basis, based on the total mass of the crude oil and refinable petroleum feedstock, respectively.

Suitably, in each of the first to thirteenth aspects of the invention, said one or more bis-(hydrocarbyl)glycerophosphoethanolamine(s) is added to crude oil or refinable petroleum feedstock, respectively, in an amount of less than or equal to 10000, preferably less than or equal to 5000, preferably less than or equal to 2000, preferably less than or equal to 1500, ppm by mass on an active ingredient basis, based on the total mass of the crude oil and refinable petroleum feedstock, respectively.

Suitably, in each of the first to thirteenth aspects of the invention, when a combination of said one or more bis-(hydrocarbyl)glycerophosphocholine(s), as defined herein, and said one or more bis-(hydrocarbyl)glycerophosphoethanolamine(s), as defined herein, is added to crude oil or a refinable petroleum feedstock, the combined treat rate of said bis-(hydrocarbyl)glycerophosphocholine(s) and bis-(hydrocarbyl)glycerophosphoethanolamine(s) is from 2 to 10000, preferably 2 to 5500, preferably 10 to 5000, preferably 10 to 3000, preferably 15 to 3000, preferably 20 to 3000, preferably 40 to 2000, ppm by mass on an active ingredient basis, based on the total mass of the crude oil or refinable petroleum feedstock, respectively.

Unexpectedly, it has been found that if a relatively high concentration of the lyso-derivatives of said one or more glycerophospholipid(s), as defined herein, especially the lyso-derivatives of said one or more bis-($C_{10}$ to $C_{30}$ hydrocarbyl)glycerophosphocholine(s) and/or lyso-derivatives of said one or more bis-($C_{10}$ to $C_{30}$ hydrocarbyl)glycerophosphoethanolamine(s) (i.e., where one or both hydrocarbyl groups have been removed from said bis-(hydrocarbyl)glycerophosphocholine(s) and/or from said bis-(hydrocarbyl)glycerophosphoethanolamine(s)) then this may reduce the capacity of crude oil or a refinable petroleum feedstock to solvate and/or disperse asphaltenes therein, and/or decrease the solubility and/or dispersibility of asphaltenes in crude oil or a refinable petroleum feedstock, and/or increase deposition of asphaltenes from crude oil or a refinable petroleum feedstock.

Suitably, in each of the first to thirteenth aspects of the invention, the total amount of the lyso-derivatives of said one or more glycerophospholipid(s), as defined herein, especially the lyso-derivatives of said one or more bis-($C_{10}$ to $C_{30}$ hydrocarbyl)glycerophosphocholine(s) and/or lyso-derivatives of said one or more bis-($C_{10}$ to $C_{30}$ hydrocarbyl)glycerophosphoethanolamine(s), as defined herein, added to crude oil or a refinable petroleum feedstock is less than 500, preferably less than 300, preferably less than 250, preferably less than 200, preferably less than 150, preferably less than 100, preferably less than 75, preferably less than 50, ppm by mass on an active ingredient basis, based on the total mass of crude oil or refinable petroleum feedstock respectively.

Suitably, the mass-to-mass ratio on an active ingredient basis of the total mass of said one or more bis-($C_{10}$ to $C_{30}$ hydrocarbyl)glycerophosphocholine(s) and/or said one or more bis-($C_{10}$ to $C_{30}$ hydrocarbyl)glycerophosphoethanolamine(s) added to crude oil or a refinable petroleum feedstock to the total mass of said lyso-derivatives of said one or more bis-($C_{10}$ to $C_{30}$ hydrocarbyl)glycerophosphocholine(s) and/or lyso-derivatives of said one or more bis-($C_{10}$ to $C_{30}$ hydrocarbyl)glycerophosphoethanolamine(s) added to crude oil or a refinable petroleum feedstock is greater than or equal to 3 to 1, preferably greater than or equal to 5 to 1, preferably greater than or equal to 7 to 1.

Accordingly, the one or more glycerophospholipid(s), as defined herein, used as an additive in each aspect of the first to thirteenth aspects of the invention may be added to crude oil or a refinable petroleum feedstock by adding one or more lecithin(s) to the crude oil. This represents a preferred method of addition, as lecithin(s) are easy to handle, storage stable and readily available commercially.

Suitably, said one or more lecithin(s) may be in solid form (e.g., particulates, powder) or liquid form, such as for example, a solution, dispersion, suspension or emulsion. Preferably, said lecithin(s) is in liquid form, more preferably liquid form including an organic solvent, especially an aromatic organic solvent. Suitable aromatic solvents include xylene and toluene.

Suitably, when the one or more glycerophospholipid(s), as defined herein, is added to the crude oil/refinable petroleum feedstock by addition of one or more lecithin(s), said lecithin(s) is added in an amount so as to deliver an effective amount of said glycerophospholipid(s), as defined herein, to the crude oil or refinable petroleum feedstock, especially in an amount so as to deliver the preferred amount(s) of said preferred bis-($C_{10}$ to $C_{30}$ hydrocarbyl)glycerophosphocholine(s) and/or bis-($C_{10}$ to $C_{30}$ hydrocarbyl)glycerophosphoethanolamine(s), as defined herein, to said crude oil or refinable petroleum feedstock, respectively.

Suitably, in each aspect of the invention, said one or more lecithin(s) may be added to crude oil or a refinable petroleum feedstock, respectively, in an amount of less than or equal to 10000, preferably less than or equal to 7500, preferably less than or equal to 5000, preferably less than or equal to 3000, preferably less than or equal to 2000, ppm by mass of lecithin(s), based on the total mass of crude oil or refinable petroleum feedstock, respectively.

Suitably, in each aspect of the invention, said one or more lecithin(s) may be added to crude oil or a refinable petroleum feedstock, respectively, in an amount of greater than equal to 50, preferably greater than or equal to 100, preferably greater than or equal to 150, preferably greater than or equal to 200, preferably greater than or equal to 250, preferably greater than or equal to 300, ppm by mass of lecithin(s), based on the total mass of crude oil or refinable petroleum feedstock, respectively.

Suitably, said lecithin(s) may be obtained from animal, plant or microbial sources. Preferably, when one or more lecithin(s) is used as the source of said one or more glycerophospholipid(s), the lecithin is obtained from a plant, more preferably a vegetable oil, even more preferably soya bean, cottonseed, corn, sunflower, rapeseed, especially soybean. The vegetable oil may be derived from a non-genetically modified plant or a genetically modified plant. Suitably, the lecithin may be in unrefined form or a refined form, such as a de-oiled lecithin. A highly preferred source of lecithin is from soya bean.

Preferably, the lecithin(s) includes a relatively high concentration of said preferred one or more bis-($C_{10}$ to $C_{30}$ hydrocarbyl)glycerophosphocholine(s), as defined herein, and/or said preferred one or more bis-($C_{10}$ to $C_{30}$ hydrocarbyl)glycerophosphoethanolamine(s), as defined herein, on an active ingredient basis based on the total mass of the lecithin material.

Suitably, said one or more bis-($C_{10}$ to $C_{30}$ hydrocarbyl) glycerophosphocholine(s), as defined herein, is present in said one or more lecithin(s) in an amount of at least 8.5, preferably at least 9, more preferably at least 10, more preferably at least 11, more preferably at least 12, mass % on an active ingredient basis, based on the total mass of the lecithin material [i.e., based on the total mass of all components constituting the lecithin(s) but not including any solvents].

Suitably, said one or more bis-($C_{10}$ to $C_{30}$ hydrocarbyl) glycerophosphocholine(s), as defined herein, is present in said one or more lecithin(s) in an amount of less than 50, preferably less than 45, more preferably less than 40, preferably less than 35, mass % on an active ingredient basis, based on the total mass of the lecithin material [i.e., based on the total mass of all components constituting the lecithin(s) but not including any solvent(s)].

Suitably, said one or more bis-($C_{10}$ to $C_{30}$ hydrocarbyl) glycerophosphocholine(s), as defined herein, is present in said one or more lecithin(s) in an amount of at least 15, preferably at least 20, more preferably at least 25, more preferably at least 30, mass % on an active ingredient basis, based on the total mass of phospholipid(s) in the lecithin(s) material.

Suitably, said one or more bis-($C_{10}$ to $C_{30}$ hydrocarbyl) glycerophosphoethanolamine(s), as defined herein, is present in said one or more lecithin(s) in an amount of at least 5.0, preferably at least 5.5, more preferably at least 6, more preferably at least 7, more preferably at least 8, mass % on an active ingredient basis, based on the total mass of the lecithin material [i.e., based on the total mass of all components constituting the lecithin(s), but not including any solvents].

Suitably, said one or more bis-($C_{10}$ to $C_{30}$ hydrocarbyl) glycerophosphoethanolamine(s), as defined herein, is present in said one or more lecithin(s) in an amount of less than 30, preferably less than 25, more preferably less than 20, mass % on an active ingredient basis, based on the total mass of the lecithin material [i.e., based on the total mass of all components constituting the lecithin(s) but not including any solvent(s)].

Suitably, said one or more bis-($C_{10}$ to $C_{30}$ hydrocarbyl) glycerophosphoethanolamine(s), as defined herein, is present in said one or more lecithin(s) in an amount of at least 8, preferably at least 9, preferably at least 10, more preferably at least 12, more preferably at least 15, mass % on an active ingredient basis, based on the total mass of phospholipid(s) in the lecithin(s) material.

Suitably, when the one or more glycerophospholipid(s), as defined herein, is added in the form of one or more lecithin(s), said lecithin(s) includes a relatively low amount of the lyso-derivatives of said one or more glycerophospholipid(s), as defined herein, especially the lyso-derivatives of said one or more bis-($C_{10}$ to $C_{30}$ hydrocarbyl)glycerophosphocholine(s) and/or lyso-derivatives of said one or more bis-($C_{10}$ to $C_{30}$ hydrocarbyl)glycerophosphoethanolamine(s) (i.e., where one or both hydrocarbyl groups have been removed from said bis-(hydrocarbyl)glycerophospho choline(s) and/or from said bis-(hydrocarbyl)glycerophosphoethanol-amine(s)).

Suitably, the total amount of lyso-derivatives of said one or more bis-(hydrocarbyl)glycerophosphocholine(s), as defined herein, and/or lyso-derivatives of said one or more bis-(hydrocarbyl)glycerophosphoethanolamine(s), as defined herein, (i.e., wherein one or both hydrocarbyl groups have been removed from said bis-(hydrocarbyl)glycerophosphocholine(s) and/or from said bis-(hydrocarbyl)glycerophosphoethanolamine(s)), especially the total amount of lyso-derivatives of said one or more mono-($C_{10}$ to $C_{30}$ hydrocarbyl)glycerophosphocholine(s) and/or lyso-derivatives of said one or more mono-($C_{10}$ to $C_{30}$ hydrocarbyl) glycerophosphoethanolamine(s), present in said lecithin(s) is less than 4.0, preferably less than 3.75, more preferably less than 3.5, % by mass on an active ingredient basis, based on the total mass of the lecithin material (i.e., based on the total mass of all components constituting the lecithin(s) but not including any solvent(s)).

Preferably, the mass-to-mass ratio on an active ingredient basis of the total mass of said one or more bis-($C_{10}$ to $C_{30}$ hydrocarbyl)glycerophosphocholine(s) and/or said one or more bis-($C_{10}$ to $C_{30}$ hydrocarbyl)glycerophosphoethanolamine(s) to the total mass of said lyso-derivatives of said one or more bis-($C_{10}$ to $C_{30}$ hydrocarbyl)glycerophosphocholine(s) and/or lyso-derivatives of said one or more bis-($C_{10}$ to $C_{30}$ hydrocarbyl)glycerophosphoethanolamine(s) present in said lecithin(s) is greater than or equal to 3 to 1, preferably greater than or equal to 5 to 1, preferably greater than or equal to 7 to 1.

Unexpectedly, it has been found that if said one or more glycerophospholipid(s), as defined herein, especially said preferred one or more bis-($C_{10}$ to $C_{30}$ hydrocarbyl)glycerophosphocholine(s) and/or bis-($C_{10}$ to $C_{30}$ hydrocarbyl)glycerophosphoethanolamines(s), as defined herein, is added to crude oil or a refinable petroleum feedstock in liquid form (e.g., solution, suspension, dispersion) then this may further enhance the capacity of crude oil/refinable petroleum feedstock to solvate and/or disperse asphaltenes, and/or increase the solubility and/or dispersibility of asphaltene(s) in crude oil/refinable petroleum feedstock. The addition of said one or more glycerophospholipid(s) in liquid form represents a convenient mode of addition. Further, when said one or more glycerophospholipid(s) is in liquid form and said liquid includes an organic solvent, especially an aromatic organic solvent (e.g., xylene, toluene, naptha), then this may further enhance the capacity of crude oil/refinable petroleum feedstock to solvate and/or disperse asphaltene(s) therein, and/or increase the solubility and/or dispersibility of asphaltenes in crude oil/refinable petroleum feedstock, and/or reduce deposition of asphalatenes from crude oil/refinable petroleum feedstock.

Thus, according to a preferred embodiment of each of the first to thirteenth aspects of the invention, said one or more glycerophospholipid(s), especially said preferred one or more bis-($C_{10}$ to $C_{30}$ hydrocarbyl)glycerophosphocholine(s) and/or one or more bis-($C_{10}$ to $C_{30}$ hydrocarbyl)glycerophosphoethanolamines(s), as defined herein, is in liquid form and includes an organic solvent, especially an aromatic solvent. Suitably, this may be achieved by forming a solution, dispersion and/or suspension of lecithin(s) in an organic, preferably aromatic, solvent.

Suitably, in each of the first to thirteenth aspects of the invention, the crude oil or refinable petroleum feedstock, respectively, has an asphaltene content.

Suitably, in each of the first to thirteenth aspects of the invention, the capacity of a crude oil or refinable petroleum feedstock to solvate and/or disperse asphaltenes is enhanced compared with a crude oil or refinable petroleum feedtstock, respectively, not including said glycerophospholipid(s).

Suitably, in each of the first to thirteenth aspects of the invention, the solubility and/or dispersibility of asphaltenes in a crude oil or refinable petroleum feedstock is enhanced compared with a crude oil or refinable petroleum feedstock, respectively, not including said glycerophospholipid(s).

Suitably, in each of the first to thirteenth aspects of the invention, the deposition of asphaltenes from crude oil or a refinable petroleum feedstock is reduced compared with a crude oil or refinable petroleum feedstock, respectively, not including said glycerophospholipid(s).

The increased capacity of a crude oil or refinable petroleum feedstock to solvate and/or disperse asphaltenes therein, and/or the increased solubility and/or dispersibility of asphaltenes in a crude oil or refinable petroleum feedstock, and/or reduced deposition of aspahltenes from crude oil or refinable petroleum feedstock may permit (i) increased amounts of asphaltenes to be solvated and/or dispersed in a crude oil/refinable petroleum feedstock; and/or, (ii) formation of a crude oil, or formation of a crude oil blend, having a defined asphaltene content wherein the asphaltenes are more stably solvated and/or dispersed therein (i.e., asphaltene precipitation from and/or agglomeration in the crude oil is reduced).

Suitably, in each of the first to thirteenth aspects of the invention, the crude oil comprises a single type of crude oil or a crude oil blend comprising two or more different types of crude oil. The single type of crude oil or crude oil blend may further include a hydrocarbon oil (i.e., not a crude oil).

Suitably, in each of the first to thirteenth aspects of the invention, the crude oil comprises a single type of crude oil having an asphaltene content or a crude oil blend comprising two or more different types of crude oil, wherein at least one, preferably each of said different type of, crude oil has an asphaltene content.

Suitably, in each of the first to thirteenth aspects of the invention, the crude oil represents, or forms part of, a refinable petroleum feedstock, which may be refined in a petroleum refinery operation at a petroleum refinery. In other words, the crude oil is a refinable crude oil (i.e., it is in a form suitable for refining at a petroleum refinery).

Suitably, the crude oil comprises intermediate (light) crude oils, medium crude oils, heavy crude oils and shale oils, and combinations thereof.

Suitably, the crude oil includes an upgraded crude oil which is subsequently refined at a petroleum refinery to produce the ultimate commercial products.

For the avoidance of doubt, when one or more bis-($C_{10}$ to $C_{30}$ hydrocarbyl)glycerophosphocholine(s), as defined herein, or one or more bis-($C_{10}$ to $C_{30}$ hydrocarbyl)glycerophosphoethanolamine(s), as defined herein, or a combination of said bis-($C_{10}$ to $C_{30}$ hydrocarbyl)glycerophosphocholine(s) and bis-($C_{10}$ to $C_{30}$ hydrocarbyl) glycerophosphoethanolamine(s), is each independently added to a crude oil we mean that each additive or the combination of additives may be independently added directly to a crude oil(s) as defined herein, each additive or the combination of additives may be independently added to a crude oil blend as defined herein, and/or each additive or the combination of additives may be independently added to a refinable petroleum feedstock comprising a crude oil or crude oil blend as defined herein.

Suitably, said one or more bis-($C_{10}$ to $C_{30}$ hydrocarbyl) glycerophosphocholine(s), as defined herein, or said one or more bis-($C_{10}$ to $C_{30}$ hydrocarbyl)glycerophosphoethanolamine(s), as defined herein, or a combination of said bis-($C_{10}$ to $C_{30}$ hydrocarbyl)glycerophosphocholine(s) and bis-($C_{10}$ to $C_{30}$ hydrocarbyl)glycerophosphoethanolamine(s), is each independently added to a crude oil at one or more crude oil production and/or processing stages before the crude oil arrives at a petroleum refinery.

Suitably, said glycerophospholipid(s) may be added to crude oil during one or more crude oil production and/or processing stages before the crude oil arrives at a petroleum refinery selected from: (i) during or before storage of crude oil in a vessel, such as in a crude oil storage tank, which tanks may be located at the wellbore region, or at intermediate locations between the wellbore region and a petroleum refinery; (ii) during or before transportation of said recovered crude oil, especially during or before transportation of said recovered crude oil from a crude oil recovery well to a petroleum refinery in one or more transportation stages (e.g., by pipeline, road (e.g., oil tanker), rail or marine vessel (e.g., ship)), wherein said glycerophospholipid(s) is added to the crude oil before or during any one of said one or more transportation stages; (iii) during or before a blending operation including the recovered crude oil, such as blending the recovered crude oil with a different type of crude oil, and/or hydrocarbon fluid, to form a crude oil blend; (iv) during or before a crude oil processing operation, such as removing gas and water from the crude oil; or, any combination of the production and/or processing operations (i), (ii), (iii), and (iv).

Suitably, when a combination of glycerophospholipids is added to a crude oil, for example a combination of said bis-(hydrocarbyl)glycerophosphocholine(s) and bis-(hydrocarbyl)glycerophosphoethanolamine(s), the respective different types of glycerophospholipids may be added to crude oil at the same one or more crude oil production and/or processing stages or each respective different type of glycerophospholipid(s) may be added to a crude oil at a different one or more crude oil production and/or processing stages. Preferably, the respective different types of glycerophospholipids are added to a crude oil at the same one or more crude oil production and/or processing stages.

Suitably, said glycerophospholipid(s) may be added to a crude oil or refinable petroleum feedstock by techniques well known to those skilled in the art, for example, the additive(s) may be blended into a crude oil or refinable petroleum feedstock, the additive(s) may be introduced into flowlines transporting a crude oil or refinable petroleum feedstock, the additive(s) may be injected into a crude oil or refinable petroleum feedstock, for example, injected into a crude oil present in the production flow path of a crude oil recovery well.

Suitably, in each of the first to thirteenth aspects, the crude oil is at ambient temperature (i.e., at a temperature of its immediate surroundings and without application of heat from an additional external heat source). Crude oil in a crude oil reservoir may be at a temperature of up to 150° C. The transportation, storage and processing of crude oil before the crude oil is refined at a petroleum refinery is dependent upon geographical location.

Suitably, said one or more glycerophospholipid(s), as defined herein, are each independently soluble or dispersible in the crude oil.

Compositions

Said one or more glycerophospholipid(s) may be used in compositions; the compositions may further contain a hydrophobic oil solubilizer and/or a dispersant for the additive(s). Such solubilizers may include, for example, surfactants and/or carboxylic acid solubilizers.

The compositions may further include, for example, viscosity index improvers, anti-foamants, antiwear agents, demulsifiers, anti-oxidants, and other corrosion inhibitors.

EXAMPLES

The present invention is illustrated by but in no way limited to the following examples.

Components

The following lecithin components and crude oil were used.

Lecithins

The following lecithins as detailed below were used in the examples:

Lecithin 1—Lecithin 5260 obtained from a genetically modified soya and commercially available from Thew Arnott, Unit 9 Tenth Avenue, Zone 3, Deeside Industrial Park, Flintshire, CH52UA.

Lecithin 2—Lecithin 6170 obtained from a genetically modified soya and likewise available from Thew Arnott.

Lecithin 3—Lecithin 4980 obtained from a non-genetically modified soya and likewise available from Thew Arnott.

Lecithin 4—Lecithin 4980 obtained from a non-genetically modified soya and likewise available from Thew Arnott.

Lecithin 5—Lecithin 5348 obtained from a non-genetically modified soya and de-oiled and likewise available from Thew Arnott.

Lecithin 6—Lecithin 5636 obtained from a non-genetically modified sunflower and de-oiled and likewise available from Thew Arnott.

Lecithin 7—Lecithin 5435 obtained from a non-genetically modified sunflower and de-oiled and likewise available from Thew Arnott.

Lecithin 8—Asolecthin obtained from a non-genetically modified soya and de-oiled and available from Sigma Aldrich.

Lecithin A—Lecithin 4705 a hydrolysed lecithin obtained from a non-genetically modified soya and likewise available from Thew Arnott.

Lecithin B—Lecithin 4687 a hydrolysed lecithin obtained from a non-genetically modified soya and likewise available from Thew Arnott.

Lecithin C—Lecithin 6194 a hydrolysed lecithin obtained from a genetically modified soya and likewise available from Thew Arnott.

Each of Lecithins 1 to 8 comprise a relatively high bis-(aliphatic ($C_{16}$ to $C_{20}$)hydrocarbyl acyl)glycerophosphocholine(s) (PC) and bis-(aliphatic ($C_{16}$ to $C_{20}$)hydrocarbyl acyl)glycerophosphoethanolamine(s) (PE) content, especially bis-(aliphatic ($C_{18}$)hydrocarbyl acyl)glycerophosphocholine(s) and bis-(aliphatic ($C_{18}$)hydrocarbyl acyl)glycerophosphoethanolamine(s) content. The hydrocarbyl acyl groups of Lecithins 1 to 8 being derived predominantly from hexadecanoic acid, octadecanoic acid, octadecadienoic acid and octadecatrienoic acid, especially from octadecadienoic acid and octadecatrienoic acid. Each of Lecithins 1 to 8 comprise a relatively low amount of the lyso-derivatives of said bis-(aliphatic ($C_{16}$ to $C_{20}$)hydrocarbyl acyl)glycerophosphocholine(s) (L-PC) and said bis-(aliphatic ($C_{16}$ to $C_{20}$)hydrocarbyl acyl)glycerophosphoethanolamine(s) (L-PE). Lecithins 1 to 8 are used to illustrate the invention.

Each of Lecithins A to C comprise a significantly lower content of bis-(aliphatic ($C_{16}$ to $C_{20}$)hydrocarbyl acyl)glycerophosphocholine(s) (PC) and bis-(aliphatic ($C_{16}$ to $C_{20}$) hydrocarbyl acyl)glycerophosphoethanolamine(s) (PE) content, especially bis-(aliphatic ($C_{18}$)hydrocarbyl acyl) glycerophosphocholine(s) and bis-(aliphatic ($C_{18}$) hydrocarbyl acyl)glycerophosphoethanolamine(s) compared with each of Lecithins 1 to 8. The hydrocarbyl acyl groups of each of Lecithins A to C being derived predominantly from hexadecanoic acid, octadecanoic acid, octadecadienoic acid and octadecatrienoic acid, especially from octadecadienoic acid and octadecatrienoic acid. Each of Lecithins A to C comprise a significantly higher amount of the lyso-derivatives of said bis-(aliphatic ($C_{16}$ to $C_{20}$)hydrocarbyl acyl)glycerophosphocholine(s) (L-PC) and said bis-(aliphatic ($C_{16}$ to $C_{20}$)hydrocarbyl acyl)glycerophosphoethanolamine(s) (L-PE) compared with Lecithins 1 to 8. Lecithins A to C are used for comparative purposes.

The relevant constituent parts of Lecithins 1 to 8 and Lecithins A to C are detailed in Table 1.

TABLE 1

| | PC mass % in lecithin | L-PC mass % in lecithin | PE mass % in lecithin | L-PE mass % in lecithin | Total phospholipid content mass % in lecithin | PC ppm by mass in 1000 ppm mass lecithin | PE ppm by mass in 1000 ppm mass lecithin |
|---|---|---|---|---|---|---|---|
| Lecithin 1 | 15.27 | 0.86 | 12.24 | 0.45 | 46.29 | 152.7 | 122.4 |
| Lecithin 2 | 16.37 | 0.86 | 12.79 | 0.46 | 49.61 | 163.7 | 127.9 |
| Lecithin 3 | 13.22 | 1.12 | 8.82 | 0.42 | 44.43 | 132.2 | 88.2 |
| Lecithin 4 | 13.77 | 0.99 | 8.00 | 0.28 | 42.61 | 137.7 | 80.0 |
| Lecithin 5 | 19.14 | 2.24 | 11.35 | 1.03 | 65.69 | 191.4 | 113.5 |
| Lecithin 6 | 24.73 | 2.06 | 9.44 | 0.55 | 69.22 | 247.3 | 94.4 |
| Lecithin 7 | 30.53 | 3.17 | 3.20 | 0.29 | 42.59 | 305.3 | 32.0 |
| Lecithin 8 (asolecithin) | 18.44 | 3.48 | 12.15 | 1.17 | 64.76 | 184.4 | 121.5 |
| Lecithin A | 8.11 | 4.41 | 5.00 | 2.13 | 37.66 | 81.1 | 50.0 |
| Lecithin B | 7.14 | 5.85 | 3.65 | 2.99 | 37.52 | 71.4 | 36.5 |
| Lecithin C | 7.54 | 5.96 | 4.58 | 5.07 | 40.65 | 75.4 | 59.6 |

Crude Oil Blend

A blend of a Columbian heavy crude oil (asphaltene content 10 wt %) and a shale oil in a weight-to-weight ratio of 1:1.

Crude Oil Asphaltene Stability/Solvation Test

The test is performed using an Automated Stability Analyser from ROFA France in accordance with ASTM-D7157. The test demonstrates the ability of a crude oil to resist destabilisation upon the addition of heptane. Results are recorded as 'S' values, the intrinsic stability of the oil with respect to precipitation of asphaltenes therefrom. Higher 'S' values indicate that the oil has a higher capacity to solvate and/or disperse asphaltenes, and the oil is more stable in respect of asphaltene flocculation and/or precipitation. The results are reported in Table 2 as a "Relative 'S' Value" with respect to the crude oil blend not including a glycerophospholipid additive.

It is evident from the results in Table 2 that addition of each of Lecithins 1-3, 5-6, and 8 to crude oil significantly enhances the capacity of crude oil to solvate and/or disperse asphaltenes therein compared with each of comparative Lecithins A to C. Each of comparative Lecithin(s) A to C include only a marginal mass-to-mass ratio excess of total PC and PE content to lyso-derivatives content, and these comparative lecithins essentially do not enhance the capacity of crude oil to solvate and/or disperse asphaltenes therein. In contrast, each of Lecithins 1-3, 5-6, and 8 where the mass-to-mass ratio of total PC and PE content to lyso-derivatives content is greater than or equal to 7 significantly enhance the capacity of crude oil to solvate and/or disperse asphaltenes therein. Further, increasing the treat rate of PC in the crude oil typically increases the capacity of crude oil to solvate and/or disperse asphaltenes therein (compare results for Lecithin 3 with Lecithin 6, and Lecithin 5 with Lecithins 1 and 2).

TABLE 2

Crude Oil Asphaltene Stability Test Results

| Additive(s) (treat rate; 1000 ppm by mass a.i.) | PC (ppm by mass a.i) | PE (ppm by mass a.i) | L-PC & L-PE (ppm by mass a.i) | PC to L-PC Ratio (mass-to-mass ratio) | PE to L-PE Ratio (mass-to-mass ratio) | PC&PE to L-PC&L-PE Ratio (mass-to-mass ratio) | Relative S-Value |
|---|---|---|---|---|---|---|---|
| None | None | None | None | None | None | None | 1.00 |
| Lecithin 1 | 152.7 | 122.4 | 13.1 | 17.7 to 1 | 27.2 to 1 | 21 to 1 | 1.042 |
| Lecithin 2 | 163.7 | 127.9 | 13.2 | 19.0 to 1 | 27.8 to 1 | 22 to 1 | 1.040 |
| Lecithin 3 | 132.2 | 88.2 | 15.4 | 11.8 to 1 | 21.0 to 1 | 14 to 1 | 1.020 |
| Lecithin 5 | 191.4 | 113.5 | 32.7 | 8.5 to 1 | 11.0 to 1 | 9 to 1 | 1.063 |
| Lecithin 6 | 247.3 | 94.4 | 26.1 | 12.0 to 1 | 17.2 to 1 | 13 to 1 | 1.063 |
| Lecithin 8 | 184.4 | 121.5 | 46.5 | 5.3 to 1 | 10.4 to 1 | 7 to 1 | 1.038 |
| Lecithin A | 81.1 | 50.0 | 65.4 | 1.83 to 1 | 2.34 to 1 | 2 to 1 | 1.006 |
| Lecithin B | 71.4 | 36.5 | 88.4 | 1.22 to 1 | 1.22 to 1 | 1.2 to 1 | 0.969 |
| Lecithin C | 75.4 | 59.6 | 110.3 | 1.26 to 1 | 0.90 to 1 | 1.2 to 1 | 1.008 |

Asphaltene Dispersancy Test

The test demonstrates the ability of additives to disperse and/or solvate flocculated asphaltenes in crude oil. A blend of Iraqi heavy crude oil (asphaltene content 6 wt %) and toluene in a weight ratio of 1:1 is used in the test. A sample of the crude oil blend (1 g) is placed in a 100 ml stability test tube, the respective glycerophospholipid additive added and mixed therewith, and then heptane is added in an amount to form a 100 ml mixture and the mixture shaken thoroughly by hand. Testing is performed at room temperature and atmospheric pressure; the tube is monitored for 18 hrs and the settling rate of asphaltene agglomerates is recorded with a camera using GoPro & LabVIEW software from National Instruments. Results are recorded as amount of settled asphaltenes (ml) over time (hours) i.e., settling rate of ml/hr. The results are reported in Table 3 as a "log rate" where a lower more negative value indicates superior dispersancy of asphaltenes in crude oil by the respective additive.

It is evident from the results in Table 3 that addition of each of Lecithins 1-5 and 7-8 to crude oil significantly increases the dispersancy/solvation of asphaltenes in crude oil compared with each of comparative Lecithins A to C.

TABLE 3

Crude Oil Asphaltene Stability Test Results

| Additive(s) | Treat Rates (ppm by mass a.i.) Lecithin | PC | PE | PC to L-PC Ratio (mass-to-mass ratio) | PE to L-PE Ratio (mass-to-mass ratio) | PC&PE to L-PC&L-PE Ratio (mass-to-mass ratio) | Dispersancy (log rate (ml/hr)) |
|---|---|---|---|---|---|---|---|
| None - crude | None | None | None | None | None | None | 0.970 |
| Lecithin 1 | 1000 | 152.7 | 122.4 | 17.7 to 1 | 27.2 to 1 | 21 to 1 | −2.556 |
| | 500 | | | | | | −1.857 |
| | 250 | | | | | | −1.054 |
| Lecithin 2 | 1000 | 163.7 | 127.9 | 19.0 to 1 | 27.8 to 1 | 22 to 1 | −2.255 |
| | 500 | | | | | | −2.000 |
| Lecithin 3 | 1000 | 132.2 | 88.2 | 11.8 to 1 | 21.0 to 1 | 14 to 1 | −1.857 |
| | 500 | | | | | | −1.598 |
| Lecithin 4 | 1000 | 137.7 | 80.0 | 13.9 to 1 | 28.6 to 1 | 17 to 1 | −1.857 |
| | 500 | | | | | | −1.556 |
| Lecithin 5 | 1000 | 191.4 | 113.5 | 8.5 to 1 | 11.0 to 1 | 9 to 1 | −3.255 |
| | 500 | | | | | | −1.857 |
| Lecithin 7 | 1000 | 305.3 | 32.0 | 9.6 to 1 | 11.0 to 1 | 10 to 1 | −1.954 |
| | 500 | | | | | | −1.778 |
| Lecithin 8 | 1000 | 184.4 | 121.5 | 5.3 to 1 | 10.4 to 1 | 7 to 1 | −1.857 |
| Lecithin A | 1000 | 81.1 | 50.0 | 1.83 to 1 | 2.34 to 1 | 2 to 1 | −0.875 |
| Lecithin B | 1000 | 71.4 | 36.5 | 1.22 to 1 | 1.22 to 1 | 1.2 to 1 | −0.875 |
| | 500 | | | | | | 0.301 |
| Lecithin C | 1000 | 75.4 | 59.6 | 1.26 to 1 | 0.90 to 1 | 1.2 to 1 | −1.420 |
| | 500 | | | | | | −0.921 |

Solvent Effect

A combination of Lecithin 1 (1 part by mass) and an organic aromatic solvent Solvesso™150 (9 parts by mass) was evaluated in the dispersancy test as described herein. The results are present in Table 4.

TABLE 4

Solvent Effect

| | Treat Rate of Lecithin (ppm by mass a.i.) | Dispersancy (log rate ml/hr) |
|---|---|---|
| None-Crude | None | 0.970 |
| Solvesso ™ 150 | None | 0.926 |
| Lecithin 1 | 1000 | −2.556 |
| Lecithin 1 and Solvesso ™ 150 | 1000 | −3.255 |

The results demonstrate that the aromatic solvent alone was essentially neutral, and the solvent did not affect dispersion and/or solvation of flocculated asphaltenes in crude oil. However, when the aromatic organic solvent was used in combination with Lecithin a significant boost of Lecithin 1 to disperse and/or solvate flocculated asphaltenes in crude oil was observed.

5 Rod Thermal Deposition Test (5-RTDT)

The 5-RTDT provides the degree of fouling, especially asphaltene fouling, in a petroleum refinery operation on a refinable petroleum feedstock.

Crude Oil Blend

A blend of Basra heavy crude oil having an asphaltene content, Enbridge crude oil plus shale oil at respective volume percentages of 40, 10 and 30% diluted with decane 20%.

Testing

Tests were carried out using 150 ml samples of the crude oil blend containing no additives (as a control), and the crude oil blend containing Lecithin 1 (1000 ppm by mass active ingredient), added to the crude oil blend as a cutback.

The tests used a 5 Rod Thermal Deposition Test (5-RTDT) which aims to simulate refinery antifoulant performance. The 5-RTDT uses apparatus having five independently heated test sections connected in series. Each test section comprises an electrically resistively heated steel rod encased in an outer steel jacket, which is electrically isolated from the rod. The test crude oil sample flows in the cavity between the rod and the jacket. The rod temperature is controlled at the centre point of the rod and is maintained constant throughout the test. As the crude oil flows over the hot rod in each test section, it absorbs heat from the rod; the temperature of the crude oil entering and leaving each test section is recorded. If deposits accumulate on the rod surface, they reduce the heat transfer efficiency from the rod to the crude oil thus giving rise to a reduction in the temperature of the crude oil leaving and entering the respective test section.

The difference in crude oil outlet temperature (ΔT ° C.) between the start to the end of the test is calculated and summed for each of the five rods (i.e., each test section). A larger ΔT ° C. number indicates a greater temperature difference and hence worse fouling. Tests were carried out for five hours with respective rod temperatures of 120, 160, 200, 240 and 280° C. The results of the tests are shown in Table 5.

TABLE 5

Anti-Fouling Results

| Additive(s) (treat rate; ppm a.i.) | ΔT (° C.) |
|---|---|
| None | −64 |
| Lecithin 1 (1000 ppm) | −12 |

The results demonstrate that addition of Lecithin 1 (1000 ppm by mass of lecithin, 152.7 ppm by mass of PC on an a.i. basis PC, 122.4 ppm by mass on an a.i. basis of PE) to the crude oil blend reduced fouling by 433% compared to the crude oil blend not including any additives.

What is claimed is:

1. A method of improving the transportation of a crude oil which has been recovered from a crude oil well, the method comprising the steps of:

(i) adding one or more glycerophospholipid(s) to a crude oil before and/or during the transportation of said crude oil; and, (ii) transporting the crude oil by a crude oil flow line, by road vehicle, by railway vehicleor by watercraft, or a combination thereof, wherein said one or more glycerophospholipid(s) is selected from: (i) one or more bis-(C10 to C30 hydrocarbyl)glycerophosphocholine(s); (ii) one or more bis-(C10 to C30 hydrocarbyl)glycerophosphoethanolamine(s); or, (iii) a combination of said bis-(C10 to C30 hydrocarbyl)glycerophosphocholine(s) and bis-(C10 to C30 hydrocarbyl)glycerophosphoethanolamine(s).

2. The method of claim 1, wherein said one or more glycerophospholipid(s) is added to the crude oil in an amount sufficient to enhance the capacity of the crude oil to solvate or disperse asphaltenes therein.

3. The method of claim 1, wherein said one or more glycerophospholipid(s) is added to the crude oil in an amount sufficient to enhance the solubility and/or dispersibility of asphaltenes in said crude oil.

4. The method of claim 1, wherein said one or more glycerophospholipid(s) is added to the crude oil in an amount sufficient to reduce deposition of asphaltenes from said crude oil.

5. The method of claim 1, wherein said one or more glycerophospholipid(s) is added to the crude oil during transportation of the crude oil and said crude oil comprises a crude oil stream being transported by a crude oil flow line.

6. The method of claim 1, wherein said one or more glycerophospholipid(s) is added to the crude oil during storage of the crude oil or during a crude oil processing operation performed on the crude oil.

7. The method of claim 1, wherein the crude oil is transported by a crude oil flow line selected from the group consisting of a pipe, a tubular structure and a pipeline.

8. The method of claim 1, wherein the crude oil is being transported to a petroleum refineryin one or more transportation stages by said transportation means, and said one or more glycerophospholipid(s) is added to the crude oil before and/or during any of said one or more transportation stages.

9. The method of claim 1, wherein said crude oil comprises a single grade crude oil, an upgraded crude oil, or a crude oil blend comprising two or more crude oils.

10. The method of claim 1, wherein the method or use is in a petroleum refinery operation performed on the crude oil, and the crude oil is heated at an elevated temperature during the petroleum refinery operation.

11. A method for reducing or preventing asphaltene fouling of a refinery vessel during a petroleum refinery operation of a refinable petroleum feedstock, the method comprising providing a refinable petroleum feedstock in fluid communication with a refinery vessel during a petroleum refinery operation, the refinable petroleum feedstock being at an elevated temperature during the refinery operation, and the refinable petroleum feedstock including one or more glycerophospholipid(s), wherein said one or more glycerophospholipid(s) is selected from: (i) one or more bis-($C_{10}$ to $C_{30}$ hydrocarbyl)glycerophosphocholine(s); (ii) one or more bis-($C_{10}$ to $C_{30}$ hydrocarbyl)glycerophosphoethanolamine(s); or, (iii) a combination of said bis-($C_{10}$ to Cao hydrocarbyl)glycerophosphocholine(s) and bis-($C_{10}$ to Cao hydrocarbyl)glycerophosphoethanolamine(s).

12. A system for refining a refinable petroleum feedstock, the system comprising:

(a) a refinery vessel for refining the refinable petroleum feedstock at an elevated temperature; and, (b) a refinable petroleum feedstock in fluid communication with the refinery vessel, wherein the refinable petroleum feedstock includes one or more glycerophospholipid(s), wherein said one or more glycerophospholipid(s) is selected from: (i) one or more bis-($C_{10}$ to $C_{30}$ hydrocarbyl)glycerophosphocholine(s); (ii) one or more bis-($C_{10}$ to $C_{30}$ hydrocarbyl)glycerophosphoethanolamine(s); or, (iii) a combination of said bis-($C_{10}$ to $C_{30}$ hydrocarbyl)glycerophosphocholine(s) and bis-($C_{10}$ to $C_{30}$ hydrocarbyl)glycerophosphoethanolamine(s).

13. The method of claim 11, wherein each hydrocarbyl group of said one or more bis-($C_{10}$ to $C_{30}$ hydrocarbyl) glycerophosphoethanolamine(s) and of said one or more bis-($C_{10}$ to $C_{30}$ hydrocarbyl) glycerophosphoethanol amine(s), independently represents, at each occurrence, an aliphatic $C_{10}$ to $C_{30}$ alkylacyl group or an aliphatic $C_{10}$ to $C_{30}$ alkenylacyl group.

14. The method of claim 11, wherein said one or more glycerophospholipid(s) is added to said crude oil or said refinable petroleum feedstock in an amount of greater than or equal to 5 ppm by mass on an active ingredient basis, based on the total mass of the crude oil or refinable petroleum feedstock.

15. The method of claim 11, wherein a mass-to-mass ratio on an active ingredient basis of the total mass of said one or more bis-($C_{10}$ to $C_{30}$ hydrocarbyl)glycerophosphocholine(s) and/or said one or more bis-($C_{10}$ to Cao hydrocarbyl)glycerophosphoethanolamine(s) added to crude oil or a refinable petroleum feedstock to the total mass of said lyso-derivatives of said one or more bis-($C_{10}$ to $C_{30}$ hydrocarbyl) glycerophosphocholine(s) and/or lyso-derivatives of said oneor more bis-($C_{10}$ to $C_{30}$ hydrocarbyl)glycerophosphoethanolamine(s) added to crude oil or a refinable petroleum feedstock is greater than or equal to 3 to 1.

16. The method of claim 11, wherein the one or more glycerophospholipid(s) is in liquid form and includes an aromatic organic solvent.

17. The method of claim 11, wherein the one or more glycerophospholipid(s) is added to the crude oil or the refinable petroleum feedstock by adding one or more lecithins to said crude oil or said refinable petroleum feedstock.

18. The method of claim 11, wherein the one or more glycerophospholipids is added to the crude oil and refinable petroleum feedstock, respectively, in an amount of greater than or equal to 10 ppm by mass on an active ingredient basis, based on the mass of crude oil and refinable petroleum feedstock, respectively.

19. The method of claim 11, wherein the one or more glycerophospholipid(s) is used with or as emulsion-breakers (for demulsification), corrosion inhibitors, hydrate inhibitors, scale inhibitors, flow improvers, wax deposition inhibitors (or paraffin suppressants), pour-point depressants, viscosity improvers and/or other additives.

* * * * *